US005320761A

United States Patent [19]

Hoult et al.

[11] Patent Number: 5,320,761

[45] Date of Patent: Jun. 14, 1994

[54] LUBRICANT FLUID COMPOSITION AND METHODS FOR REDUCING FRICTIONAL LOSSES THEREWITH IN INTERNAL COMBUSTION ENGINES

[75] Inventors: David P. Hoult, Cambridge, Mass.; Francis E. Brown, Conroe, Tex.

[73] Assignee: Pennzoil Products Company, Houston, Tex.

[21] Appl. No.: 919,412

[22] Filed: Jul. 27, 1992

Related U.S. Application Data

[63] Continuation-in-part of Ser. No. 658,643, Feb. 22, 1991, abandoned.

[51] Int. Cl.[5] ..... C10M 171/02

[52] U.S. Cl. ..... 252/9

[58] Field of Search ..... 252/9

[56] References Cited

U.S. PATENT DOCUMENTS

| | | | |
|---|---|---|---|
| 3,383,311 | 5/1968 | Groszek | 252/29 |
| 3,384,582 | 5/1968 | Groszek | 252/25 |
| 3,384,583 | 5/1968 | Groszek | 252/29 |
| 3,384,584 | 5/1968 | Groszek | 252/30 |
| 4,224,173 | 9/1980 | Reick | 252/52 A |
| 4,648,981 | 3/1987 | Dulin | 252/32.7 E |
| 4,681,974 | 7/1987 | Hisamoto et al. | 560/87 |
| 4,844,829 | 7/1989 | Wilburn et al. | 252/56 R |
| 4,956,111 | 9/1990 | Wilburn et al. | 252/56 R |
| 5,022,492 | 6/1991 | Ohno et al. | 184/5 |

OTHER PUBLICATIONS

Coyne and Elrod, "Conditions for the Rapture of a Lubricating Film", Part I and II, Journal of Lubrication Technology, Jul. 1970, pp. 451–456, and Jan. 1971, pp. 156–167.

Kuliyev et al., "About the Rational Use of Motor Oil Additives", Foreign Technology Division, Air Force Systems Command, Wright Patterson Air Force Base, Report No. FT-MI-466-68, Jun. 1969, pp. 1–13.

Davis et al., "The Density and Surface Tension of Synthetic Turbine Engine Lubricants from 100–400F", Technical Report AFAPL-TR-71-104, Feb. 1972.

*Primary Examiner*—Jerry D. Johnson

*Attorney, Agent, or Firm*—Lowe, Price, Leblanc & Becker

[57] ABSTRACT

Lubricant efficiency in an internal combustion engine is improved by determining the frictional coefficient of the lubricant and adding appropriate additives to adjust viscosity and surface tension to optimum ranges. This results in improved fuel economy and reduced engine wear.

7 Claims, 10 Drawing Sheets

LUBRICANT FLUID COMPOSITION AND METHODS FOR REDUCING FRICTIONAL LOSSES THEREWITH IN INTERNAL COMBUSTION ENGINES

This is a continuation-in-part of copending U.S. application, Ser. No. 07/658,643, filed on Feb. 22, 1991, now abandoned.

FIELD OF THE INVENTION

This invention relates to a lubricant fluid composition, and more particularly to methods for ensuring high lubrication efficiency to reduce friction-related power losses in internal combustion engines.

BACKGROUND OF THE PRIOR ART

The use of lubricant fluids to reduce frictional losses in internal combustion engines is well known. Lubricant fluids typically contain either a hydrocarbon-based or synthetic principal lubricant oil, with additives selected to ensure that the composite lubricant fluid will serve to effectively lubricate relatively moving internal combustion engine parts under anticipated operating conditions.

Over time, through both analysis and experience, various characteristics of lubricant fluids have been better understood and improved. This is usually accomplished by adding one or more additives selected to adjust specific properties and monitoring the performance characteristics of the composite lubricant fluid. Additives such as viscosity index improvers are employed to control the viscosity, and pour point depressants are added as needed to control the freezing point of the composite lubricant fluid. Various detergent packages, corrosion inhibitors, and the like, may be added for their specific benefits.

A variety of multigrade lubricant fluids have been developed and are found to improve engine efficiency as measured by reductions in fuel consumption. In a study by McGeehan, J. A. "A Literature Review of the Effects of Piston and Ring Friction and Lubricating Oil Viscosity on Fuel Economy", SAE No. 780673, it is noted that multigrade lubricant fluids give slightly better fuel economy in reciprocating engines than do single-grade lubricant fluids. However, very little is known as to why improvements in fuel efficiency and reduced fuel consumption are achieved by the use of a multigrade lubricant fluid. Various explanations have been proposed to explain this disparity, but these, by necessity, until now, have been based on measurements of a single film thickness made in the main bearing of an internal combustion engine. See, for example, SAE Reports Nos. 869376, 880681, and 892151.

Other studies have considered the influence of cavitation in the lubricant fluid, in regions between relatively moving elements, as an important factor which determines the load bearing capability of the lubricant fluid film providing the lubrication. Theories concerning cavitation were first proposed by Reynolds in the early 1900s and these led to the development of the so-called Reynolds theory of lubrication. More recently, Coyne and Elrod, in "Conditions for the Rupture of a Lubricating Film: Parts I and II", Journal of Lubrication Technology, July 1970, have developed analyses which include the effects of surface tension in the lubricating mechanism. The influence of surface tension at the boundary conditions, and the task of specifying this in the analyses, thus adds a new parameter to both the analytical and experimental considerations.

The motor vehicle industry and the oil industry are both very concerned with energy conservation and oil consumption, and in the parameters involved in promoting engine efficiency and reducing oil consumption to avoid potential energy shortages. There is, therefore, significant interest in developing lubricant fluids and procedures for ensuring selected characteristics thereof for improved lubrication in internal combustion engines. To meet this need, it is necessary to develop an accurate understanding of the behavior of composite lubricant fluids, particularly where lubrication is provided to piston rings, both to develop a reliable model of the lubrication phenomenon and to enable the development of optimum lubricating fluid compositions. The goal of such efforts is to provide better lubricant fluids and an understanding of how to ensure that their desirable properties are maintained during prolonged use in internal combustion engines, to decrease friction-related losses, and to thereby increase engine efficiency and reduce fuel consumption.

The present invention is based on both analysis and empirical verification to provide improvements in lubricant fluid compositions and methods for ensuring efficient lubrication in internal combustion engines.

The following symbols and nomenclature are employed in the description of the invention.

NOMENCLATURE a—Piston ring radius (mm)
b—Wetted ring width (mm)
b*—Nondimensional wetted width (mm)
B—Piston ring width (mm)
f—Friction coefficient of lubricant fluid
G—Bearing number (a defined parameter)
h—Fluid film height ($\mu$m)
$h_o$—Minimum fluid film height under piston ring ($\mu$m)
$h_\infty$—Fluid thickness far downstream of piston ring ($\mu$m)
P—Pressure (Pa)
$\tilde{P}_1$—Nondimensional crown land pressure
$\tilde{P}_2$—Nondimensional second land pressure
$\Delta P$—Piston ring elastic pressure (Pa)
U—Cylinder liner velocity relative to piston ring (m/s)
u—Fluid velocity in x-direction (m/s)
x—Horizontal length variable along cylinder liner (mm)
x*—Nondimensional horizontal length
$x_o$—Minimum point under ring (mm)
y—Vertical direction variable (mm)
$\Gamma$—Normalized film thickness
$\Gamma_1$—Inlet normalized film thickness
$\Gamma_2$—Outlet normalized film thickness
$\mu_\infty$—High strain dynamic viscosity (Pa-sec)
$\sigma_o$—Zero strain rate surface tension (Pa-m)
$\sigma^*$—Nondimensional surface tension gradient
$\tau_s$—Free surface shear stress (Pa)
$\tau$—Shear stress (Pa)
$\tau$—Non-dimensional shear stress
T—Surface tension (Newtons/m)

DISCLOSURE OF THE INVENTION

Accordingly, it is a principal object of this invention to provide a novel method for preparation of an engine lubricating fluid which enables it to provide improved lubrication, and thus increase engine operational efficiency and improve fuel economy in an internal combustion engine.

Another object of this invention is to provide a novel method for preparation of a lubricant fluid for use in an internal combustion engine, by controlling the roles played by lubricant fluid viscosity and surface tension effects under anticipated engine operating conditions, to thereby optimize the performance of the lubricant fluid to reduce friction losses and improve engine efficiency.

Another object of this invention is to provide a method for maintaining selected properties of a lubricant fluid within selected value ranges in order to ensure efficient lubrication to minimize friction losses in operating an internal combustion engine.

Yet another object of this invention is to provide a method employing functional relationships verified by experimental measurements to reduce lubricant friction in an internal combustion engine while maintaining a high shear viscosity in a lubricant fluid film by monitoring and regulating a surface tension property of the lubricant fluid.

In a related aspect of this invention, there is provided an improved lubricant fluid which provides improved lubrication in an internal combustion engine, to thereby obtain high engine efficiency and reduced fuel consumption.

These and other related objects of this invention are realized by providing, in a preferred embodiment according to one aspect of the invention, a method for increasing an operational efficiency of a selected internal combustion engine which includes a piston reciprocating inside a cylinder liner and has on the piston a sealing ring having a curved outer peripheral surface disposed to press outwardly against the adjacent liner surface, by controlling the frictional losses attributable to a lubricant fluid film formed between a curved outer surface of the sealing ring and the adjacent cylinder liner surface, comprising the steps of:

determining a thickness profile of the lubricant film between the outer peripheral surface of the sealing ring and the adjacent liner surface when the piston is at a mid-stroke position;

determining from the thickness profile values of the minimum lubricant film thickness $h_o$, the wetted length b of the piston ring and the overall thickness B thereof;

determining a bearing number G according to $$G=\mu_\infty Ub^2/\Delta PB\, h_o^2$$

wherein $\mu_\infty$ is the high strain dynamic viscosity, U is cylinder liner velocity (m/s), b is metted ring width, $\Delta P$ is ring elastic pressure (Pa), B is ring width (mm), and $h_o$ is fluid thickness downstream ($\mu$m);

determining values of average lubricant fluid film pressure at a first crown land and a second crown land;

determining a frictional coefficient f for the lubricant fluid at said sealing ring under engine operating conditions, in accordance with the equation $$f = G^{\frac{1}{2}} \int_o^1 \tau dx = f(\Gamma_1, \Gamma_2, P_1, P_2),$$

where the distribution of $\tilde{\tau}$, as it varies with the dimension of the piston ring is determined by solving the Reynolds equation, subject to the requirement that the piston ring carries the applied load, the upstream pressure is $\tilde{P}_1$, the downstream pressure is $\tilde{P}_2$, and the non-dimensional shear stress on the free surface where the lubricant exits the ring is $$\tilde{\tau} = \frac{1}{T_a}, \text{ where } \left(\frac{h_0}{b}\right)\sigma$$

$$T_a = \mu_\infty\, U/\sigma_o$$

wherein $\mu_\infty$ is the viscosity of the lubricant fluid at the high strain rate between the piston ring and the liner, $\sigma_o$ is the low strain rate surface tension, and $\sigma^*$ is in the range 500±75 for all lubricant fluids;

minimizing said frictional coefficient to reduce the related frictional losses while providing adequate lubrication, by adding a viscosity modifier to the lubricant to adjust or maintain the lubricant fluid viscosity in the range $3\times10^{-3}$ to $5\times10^{-3}$ Pa-sec, and adding a surface tension modifier to the lubricant to adjust or maintain the surface tension at a value not less than $2\times10^{-2}$ N/m, and preferably $2\times10^{-2}$ to $5\times10^{-2}$ N/m.

In another aspect of this invention there is provided an improved composition for a lubricant fluid, comprising:

a base oil lubricant fluid material which has a lubricant fluid viscosity in the range $3\times10^{-3}$ to $5\times10^{-3}$ Pa-sec; and a lubricant fluid surface tension of not less than $2\times10^{-2}$ Newtons/m, wherein said lubricant fluid viscosity and surface tension values are determined at a temperature corresponding to a measured temperature at a selected lubricated portion of an operating engine. In a preferred aspect of the invention, the ratio of surface tension to viscosity is maintained in the critical range. Additives may be added to the lubricant fluid to adjust the viscosity and surface tension.

BRIEF DESCRIPTION OF THE DRAWINGS

Reference is now made to the drawings wherein.

DESCRIPTION OF THE PREFERRED EMBODIMENTS

Figure 1:
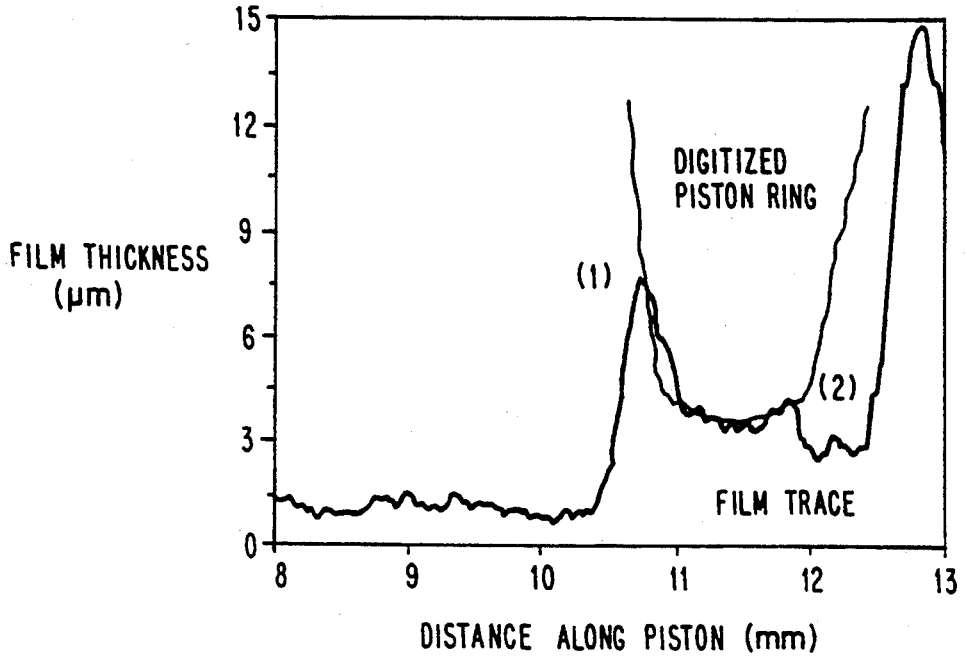
FIG. 1 is a graphical illustration of a fit between an experimentally determined digitized profile of a piston ring to an experimentally determined oil film thickness (in $\mu$m) plotted against distance (in mm) along a direction of motion of the reciprocating piston.

This invention is based on an integration of classical fluid dynamics analysis and experimental data obtained in controlled operation of a typical small, i.e., 6 h.p., single cylinder diesel engine. As will be appreciated, predictions based on classical fluid mechanics analysis depend on the quality of the analytical model employed, the realism with which boundary conditions are specified, and fluid properties, e.g., coefficient of viscosity, surface tension properties, and the like, defined.

The present invention is the result of substantial analysis incorporating both recently developed sophisticated theoretical models and experimental data obtained under typical engine operating conditions for a number of single-grade and multigrade lubricant fluids containing viscosity and surface tension modifiers as additives. One goal of the analysis and the experimental studies was to identify, inter alia, the significance of surface tension as a controllable property of a composite lubricant fluid, by the expedient of adjusting the amount of a surface tension modifying additive in the lubricant fluid composition to ensure optimum lubrication under realistic engine operating conditions.

Accordingly, the description that follows includes relevant details of previous studies, to developments incorporating the same to refine the analytical model, experimental data obtained to evaluate and modify the analytical model, and practical results derived therefrom and claimed as defining the present invention.

The experimental data utilized in developing this invention included the measurement of lubricant film thickness in an exemplary 6 h.p. internal combustion engine. Careful study of the experimental data led to the conclusion that the lubricant fluid, in performing its lubricating role to minimize frictional losses, acts in accordance with how and to what extent the piston rings of the reciprocating piston are wetted by the presence of a lubricant film between an outer surface of each piston ring and the adjacent engine cylinder liner surface. The necessary film thickness profile data were obtained by using laser-induced fluoroscopy (LIF) techniques and led to the determination that the viscosity and the surface tension of the lubricant fluid, for a specific engine operated under conditions of interest, can be related in a convenient parameter called the Taylor Number, defined as follows:

$$Ta=\mu U/\tau \quad (1)$$

where μ is the lubricant film viscosity in Pa-sec, U is the average piston speed in M/sec, and T is the surface tension in Newtons/m. In general, smaller Taylor Numbers under given operating conditions lead to reduced engine friction losses and, hence, better fuel economy.

An important aspect of the present invention is that it is based on the discovery that the effectiveness of the lubrication, and the consequent reduced frictional losses, depend on how the piston rings are wetted by the lubricant fluid. The property which appears to have a significant influence on this is the surface tension.

As a practical matter, the development of a lubricant fluid capable of reducing friction and increasing the engine fuel economy first requires definition of a "friction coefficient" for the lubricant fluid under operating conditions. From the information needed to define such a friction coefficient, one can formulate a lubricant fluid which will have an appropriate coefficient of viscosity and surface tension. In other words, the improvements in fuel economy which are achieved by known multigrade lubrication fluids (which have improved viscosity and other characteristics) can be explained by the reduction in friction as related to the friction coefficient.

It has been discovered in developing the present invention that the ideal lubricant fluid is a multigrade lubricant in which the highest surface tension attainable has been achieved while maintaining optimum viscosity and other characteristics of the lubricant fluid The ratio of surface tension to viscosity in the lubricant is also an important characteristic. Therefore, one conclusion is that improved fuel economy is realized by increasing the surface tension in the lubricant fluid as much as possible while keeping the viscosity within an optimum range for known conditions under which modern internal combustion engines are operated, e.g , temperature, mean piston speed, and the like. Accordingly, in one aspect of the present invention, there is provided a method by which a lubricant fluid can be improved by measuring its friction coefficient in an internal combustion engine and, from the information obtained, determining the ratio of the viscous-to-surface tension forces, i.e., the reciprocal of the Taylor Number for a given piston speed, and thereby determining the appropriate viscosity and surface tension values and ratio therebetween. The desired value of surface tension and/or the viscosity can then be achieved by adding appropriate additives to the lubricant fluid in controlled manner.

Figure 2:
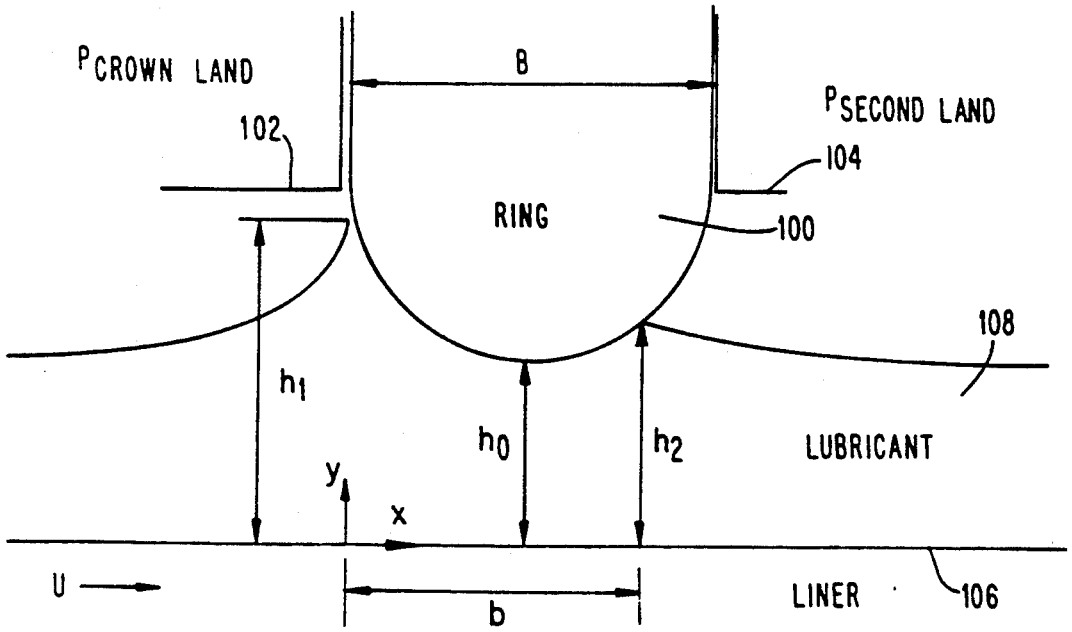
FIG. 2 is an idealized schematic diagram for explaining the form of the lubricant fluid film between a piston ring between a crown land and a second land, with respect to a direction along an engine cylinder liner in which a piston sealed by the piston ring is reciprocated.

Referring to FIG. 1, keeping in mind that the film thickness scale is enlarged by a factor of 1,000, reveals that the outer surface of the piston ring adjacent the wall of the engine cylinder liner is curved in a plane along the direction of relative motion between the piston and the cylinder liner and normal to the cylinder liner wall. The experimental data in FIG. 1 also establishes that the lubricant fluid wets the piston ring at its leading portion to a greater height than it does at its trailing portion. With this in mind, reference should now be had to FIG. 2 which, in somewhat idealized schematic form, facilitates the definition of certain geometric parameters of interest in studying the lubricant film and the wetting of a selected piston ring, e.g., the topmost ring in the piston As best seen in FIG. 2, piston ring 100 has a width "B" in the direction of motion of the piston, is disposed on the piston between a crown land 102 and a second land 104, with the cylinder liner 106 moving with a velocity "U" relative to the piston ring 100 as indicated by the arrow at the bottom left-hand corner of the figure. The width of the wetted region, along the direction of relative motion, is "b". For convenience of reference, mutually orthogonal coordinate axes x and y are shown at the liner wall In the y-direction, three heights of the lubricant film in the ring-wetted region, are identified. These are the inlet height "$h_1$", the minimum height "$h_o$" and the outlet height "$h_2$".

For convenience of reference, the above-discussed heights are replaced in the analysis and in plotting various experimental data by non-dimensional inlet and outlet heights defined as follows:

$$\Gamma_1 = h_1/h_o, \text{ and} \tag{2}$$

$$\Gamma_2 = h_2/h_o. \tag{3}$$

Figure 3:
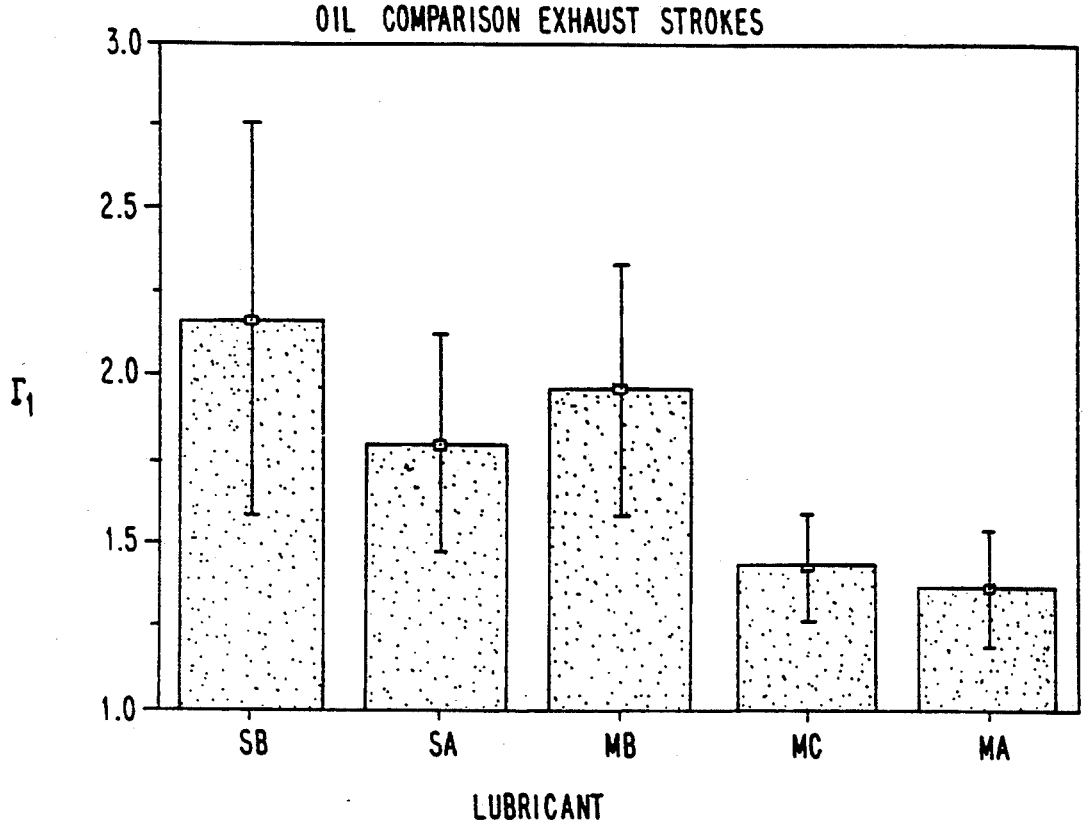
FIG. 3 is a bar plot of the normalized inlet height for various lubricant fluids, corresponding to differences in lubricant film height at inlet conditions for a given piston ring.

The experiments with a number of known multigrade and single-grade lubricant fluids resulted in data plotted in FIG. 3, which shows the non-dimensional inlet height $\Gamma_1$ for the various lubricant fluids in bar form with an indication in each case of the range of experimental values encountered.

Figure 4:
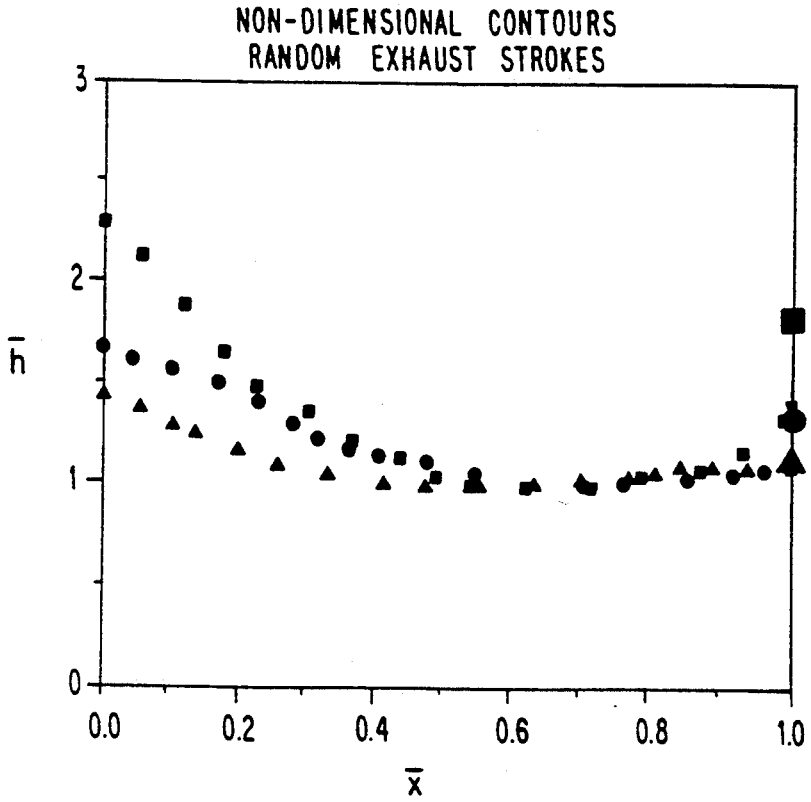
FIG. 4 is an experimental data plot of non-dimensional film inlet height for random ring contours as determined from experimentally obtained film traces from several randomly selected exhaust strokes of an internal combustion engine piston.

FIG. 4 illustrates some of the experimental data on non-dimensional contours for a piston ring, based on measurements made during randomly-selected exhaust strokes of the piston.

Figure 5:
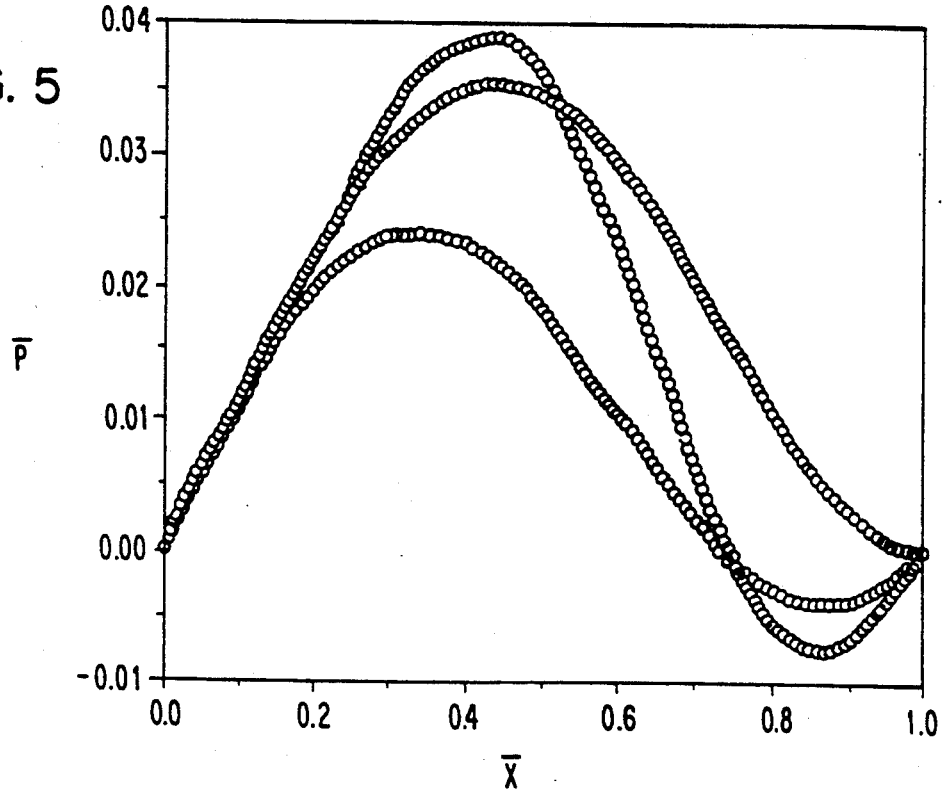
FIG. 5 presents experimentally determined data plots of non-dimensional pressure distributions under three randomly selected wetted piston ring contours.

FIG. 5 displays experimentally determined data plots of non-dimensional pressure distributions under three randomly selected wetted piston ring contours, wherein x is the distance along the direction of relative motion of the piston with respect to the cylinder liner normalized by the wetted distance "b".

Other parameters of interest are plotted in FIGS. 6–9 for completeness.

At this point, it may be helpful to persons of ordinary skill in the art reading this disclosure to review the analytical basis, presented briefly hereinbelow, for an understanding of the relationship defining a frictional coefficient "f" for a lubricant fluid.

It is known from the prior art, e.g., Coyne and Elrod, supra, that the boundary conditions at the point where a fluid film ruptures should take into account the effects of surface tension.

The Coyne and Elrod theory predicts a radius of curvature, $R_o$ of this wetted height as follows:

$$\frac{R_o}{h_\infty} = f(N) \tag{4}$$

Coyne and Elrod, supra, found that the lubricant fluid tended to wet the piston ring surface above the minimum film height.

It has been discovered from our work through the correlation of data obtained by measuring various characteristics of single-grade and multigrade lubricant fluids in internal combustion engines that, in fact, the tested fluids wetted the piston ring surface differently than would have been predicted by the work of Coyne and Elrod, supra. It was discovered in developing this invention that the wetting angle $\phi$ is much greater than 90°. Further, measurements of the wetting angle for both the inlet and outlet of the piston ring for several different lubricant fluids showed that while a single-grade lubricant tended to wet the surface more, there was no appreciable difference between the wetting angles for single-grade and multigrade lubricant fluids.

It was discovered from our work that while the relationship of $R_o$ to $h_\infty$ was not in the same range as the Coyne and Elrod theory suggests The change in pressure due to surface tension ratio $\Gamma/R_o$ was on the order of 100 Pa from the data collected. Comparing this to $\Delta p$, which is on the order of 100,000 Pa, shows that the change in pressure due to surface tension under the piston ring is almost negligible. Basically, Coyne and Elrod, supra, assumed that the x- and y-direction length scales in the separation region are in the ratio of 1:1, whereas the data generated in developing this invention showed the ratio to be of the order of 1 mm/1 $\mu$m, i.e., 1,000:1.

In developing this invention, the lubricant film thickness distribution between the top ring and the liner was studied using a laser-induced fluorescence (LIF) technique. This LIF is a known technique developed at the Massachusetts Institute of Technology and reported by Hoult et al , "Calibration of Laser Fluorescence Measurements of Lubricant Film Thickness in Engines," SAE No. 881587, International Fields of Lubricants, Meetings and Exposition, Portland, Oreg., Oct. 10–13, 1988, SAE Transactions, Volume 97-3, 1988, and by Lux et al., "Lubricant Film Thickness Measurements in a Diesel Engine Piston Ring Zone," STLE Preprint No. 90-AM-1-H-1, STLE 45th Annual Meeting, Denver, Colo., May 7–10, 1990.

Through studies of commercially-available lubricant fluids, using this laser fluorescence technology, it was discovered that cavitation is never observed at the mid-stroke location of the LIF probe. Rather, the lubricant fluid always separates at a tangent to the piston ring surface This rheology of the oil flow under the piston ring is consistent with a non-Newtonian viscosity, without elasticity. Also, it was found that the difference between the lubricant fluid type, i.e., whether it is single-grade or multigrade, corresponds to differences in inlet and outlet conditions of the top piston ring Therefore, using an analytical model, together with measured oil thickness distribution, the present inventors calculated the differences in friction between the single and multigrade lubricants. It was found that multigrade lubricant fluids have a lower friction coefficient than single-grade lubricants, and this is consistent with the reported improvements in fuel economy for a multigrade lubricant fluid.

It has been observed generally that multigrade lubricant fluids give slightly better fuel economy in reciprocating engines than single-grade lubricants. See McGeehan, J. A., SAE No. 780673 A variety of explanations have been proposed to explain this important effect However, of necessity, these hypotheses have been based on measurements of a single film thickness in an engine. Because of the strong coupling noted by the present inventors between lubricant and engine effects, deductions based upon such measurements are not believed to be always valid.

The LIF technique offers a different type of data, one in which the detailed lubricant fluid film thickness distribution can be measured in a running engine. It was discovered that by monitoring film thickness data under and around the top piston ring of an engine and by obtaining multiple data points, one can study the fluid film more effectively and in greater detail through the data collected and analyzed.

It was also discovered from this work that a strong functional dependance is present between f (the frictional coefficient), b/B (wherein b is the length of the two-dimensional fluid filled channel and B is the total width of the piston ring), $h_\infty/h_o$ and $\Gamma_1$. $\Gamma_1$ is the non-dimensionalized inlet wetting height, $h_\infty$ is the upstream oil film thickness and $h_o$ is the minimum oil film thickness under the ring. These approximations of the functional dependencies appear reasonable even given the uncertainty associated with the actual ring profile as well as the modest but not insignificant uncertainty associated with the exact location of the ring relative to measured film traces In developing this invention it was determined that contrary to virtually all published models on piston ring dynamics the lubricant fluid film does not cavitate under the top ring. The reason for this seems to be there is not enough time for voids to grow to the size required to coalesce and rupture. Further, it was found that multigrade oils wet the ring less than single-grade oils. There is a clear separation of the multigrade versus single-grades according to the friction coefficient values. The data shows a maximum top ring friction reduction of 20% through multigrade use, for the same viscosity, piston speed and engine load. If half of all the friction-related losses in the vehicle are generated in the engine, half of these are generated in the ring pack, with one quarter of that amount generated in the top ring. It is estimated that a maximum total friction-related loss reduction of 1.3% may be realized by the use of multigrade versus single-grade lubricants for just the top piston ring One would expect a further friction-related loss reduction in the rest of the piston ring pack. This result is consistent with industry data which demonstrates that 2 to 4% savings in overall economy through multigrade lubricant fluid use.

Therefore, the present invention provides a method for determining the friction coefficient f which has been normalized for speed, load and viscosity and for exhaust strokes. This friction coefficient f enables one to determine the optimum lubricant fluid composition to be used in internal combustion engines. Development of this friction coefficient takes into account a number of factors which are functionally related by the following equation:

$$f = G^{\frac{1}{2}} \int_o^1 \bar{\tau} d\bar{x} = f(\Gamma_1, \Gamma_2, \bar{P}_1, \bar{P}_2) \tag{5}$$

wherein f is the friction coefficient, G is the bearing number, $\bar{P}_1$ is the average pressure on the crown land and $\bar{P}_2$ is the average pressure on the second land, $\Gamma_1$ and $\Gamma_2$ are the non-dimensional inlet and outlet heights, and $\bar{\tau}(x)$ is the non-dimensional shear stress per unit length.

It has been discovered that determining the friction coefficient f for a lubricant fluid after normalizing for speed, load and viscosity enables one to optimize a lubricant fluid composition for any particular engine. Accordingly, the present invention provides a method for the preparation of a lubricant for use in an internal combustion engine which minimizes rupture of the lubricant fluid film under engine operating conditions, prevents film separation and reduces the likelihood of cavitation in the lubricant fluid film under the piston rings of the engine and improves efficiency of the engine.

This method includes the following steps:

(a) subjecting a selected lubricant fluid to exemplary internal combustion engine operating conditions;

(b) determining the frictional coefficient f of the lubricant in accordance with equation (5), wherein f, G, $\bar{\tau}$, $\bar{x}$, $\Gamma_1$, $\Gamma_2$, $\bar{P}_1$, and $P_2$ are as described above, and (c) adjusting the viscosity and surface tension of the lubricant fluid if necessary to minimize the friction coefficient f for the particular type of internal combustion engine by adding appropriate additives for respectively adjusting the viscosity and the surface tension of the lubricating oil to achieve the desired frictional coefficient and desired ratio of surface tension and viscosity.

FIG. 1 shows a typical realization of the observed process. Using the LIF technique, a calibrated signal measures the film thickness as the ring passes over an observation window in the cylinder liner. The theory and instrumentation techniques are known.

As shown in FIG. 1, the lubricant rises to meet the ring at the inlet. Note that the outlet condition occurs downstream of the minimum film thickness. In FIG. 2, the engine was a Kubota IDI Diesel with the observation window located at 70° ATDC for top ring passage (approximately midstroke) on the wrist pin axis.

In summary, the inlet height of the lubricant fluid depends on lubricant type, with multigrade lubricant fluids wetting the piston ring less. The lubricant fluid exits approximately tangent to the wetted piston ring surface, and no cavitation is observed under the piston ring.

It is clear that no presently available theory of piston ring lubrication incorporates boundary conditions consistent with these observations taken into account together.

All plots herein used a temperature-corrected high shear viscosity. Most of the scatter in the data arises from approximating the exact inlet and outlet heights of the lubricant fluid wetting the ring. The inlet height varies from 0.5 to about 5 μM while the outlet height is usually only about ½ μM. The current accuracy of the LIF technique is about 1/10 μm. Thus the outlet height is, in relative terms, experimentally uncertain, whereas the inlet height is relatively well defined.

The non-dimensional Reynolds equation is:

$$\frac{\partial}{\partial x}\left(\tilde{h}^3\frac{\partial \tilde{P}}{\partial x}\right)=6\frac{d\tilde{h}}{dx} \tag{6}$$

The non-dimensionalized ring shape is $h=h(x, \Gamma_1, \Gamma_2)$, with the boundary conditions:

$$\tilde{h}(0)=\Gamma_1=\frac{\delta_1+h_0}{h_0}, \text{ and} \tag{7}$$

$$\tilde{h}(1)=\Gamma_2=\frac{\delta_2+h_0}{h_0}. \tag{8}$$

The boundary conditions for pressure in the exhaust stroke are:

$$P(0)=P_1=\left(\frac{h_0^2}{U\mu b}\right)P_{Crown\ land}\cong 0; \tag{9}$$

and $$P(1)=P_2=\left(\frac{h_0^2}{U\mu b}\right)P_{Second\ land}\cong 0. \tag{10}$$

The non-dimensional load is represented by the bearing number G.

The shear stress per unit length $\tau(x)$, is related to the pressure distribution under the ring by:

$$\tau(x)=\frac{\mu U}{h(x)}-\frac{\partial P}{\partial \omega}\ \frac{h(x)}{2} \tag{11}$$

The total drag per unit length, D, on the ring is:

$$D=\int_0^b \tau(x)dx \tag{12}$$

Thus, $$D=\frac{\mu Ub}{h_0}\int_0^1 \tau(x)dx \tag{13}$$

When $b/h_0$ is eliminated one has:

$$D=\left(\frac{\mu U}{\Delta PB}\right)^{\frac{1}{2}}\Delta PB\left(G^{\frac{1}{2}}\int_0^1 \tau(x)dx\right) \tag{14}$$

Thus the friction coefficient f, normalized for speed, load, and viscosity, is $$f=G^{\frac{1}{2}}\int_0^1 \tau dx=f(\Gamma_1, \Gamma_2, P_1, P_2) \tag{15}$$

For exhaust strokes, $f=f(\Gamma_1, \Gamma_2)$.

This definition is consistent with the literature, see McGeehan, supra.

A large number of film thickness distributions h(x) were generated from oil film traces under the top piston ring. These were digitized and fitted with a second order polynomial, giving an analytic fit to h(x). For each trace, h(x) was then used to numerically calculate P(x) using the Reynolds equation and Simpson's Rule.

Figure 6:
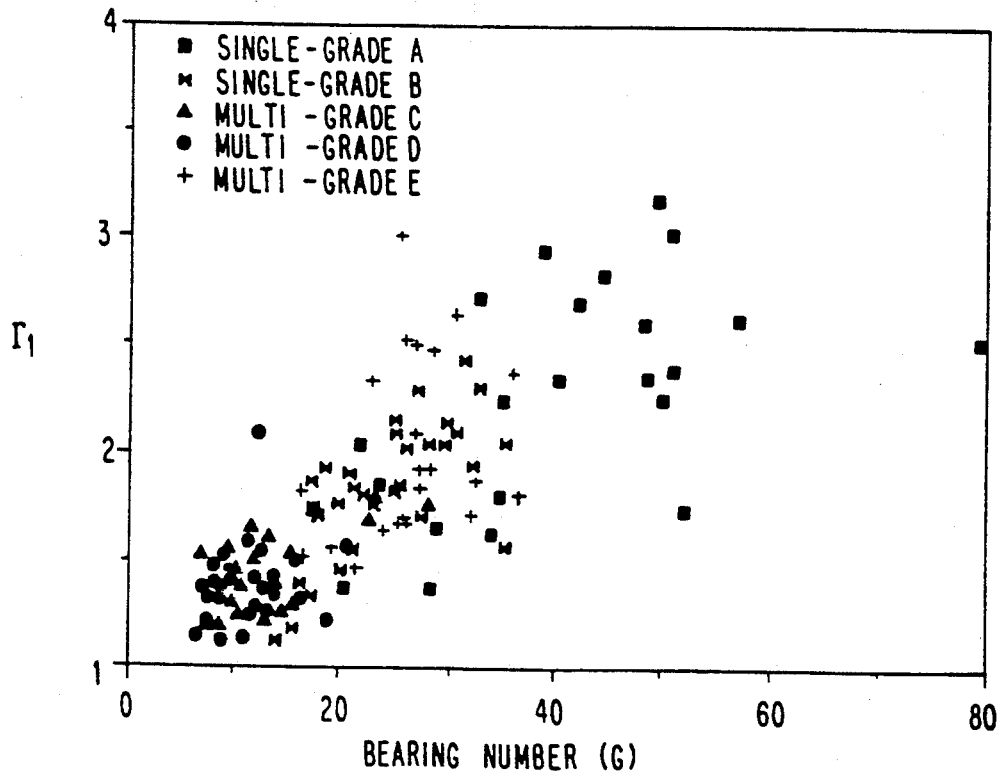
FIG. 6 is a data plot of normalized inlet wetting height against Bearing Number (G) for five different lubricant fluids.
Figure 7:
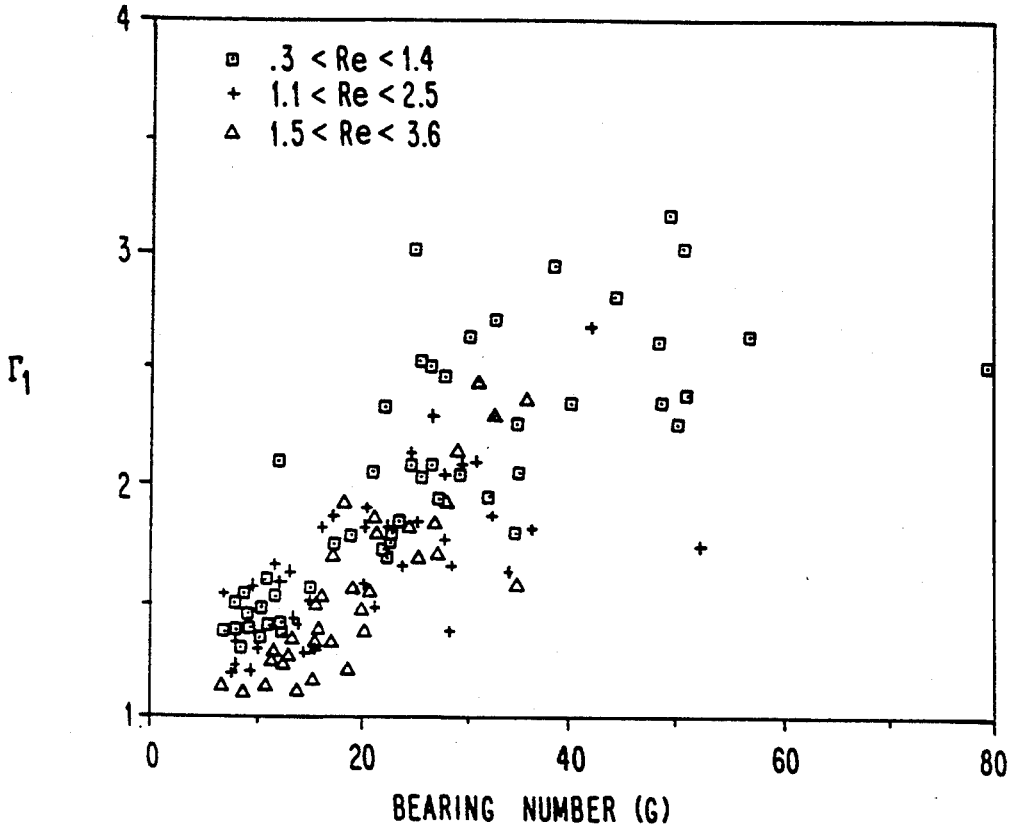
FIG. 7 is a data plot of the non-dimensional inlet height of the lubricant film against the Bearing Number (G), with data characterized by selected ranges of value for the corresponding Reynolds Number.
Figure 8:
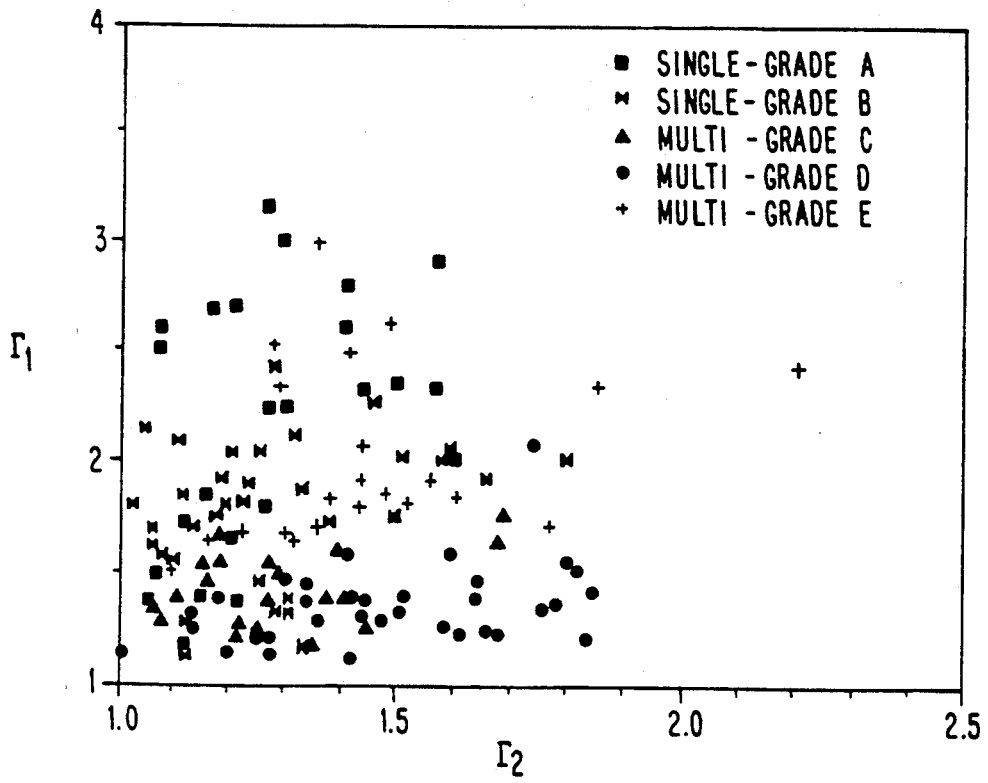
FIG. 8 is a data plot of the non-dimensional inlet wetting height against the non-dimensional outlet height, for five different lubricant fluids, for a given piston ring.
Figure 9:
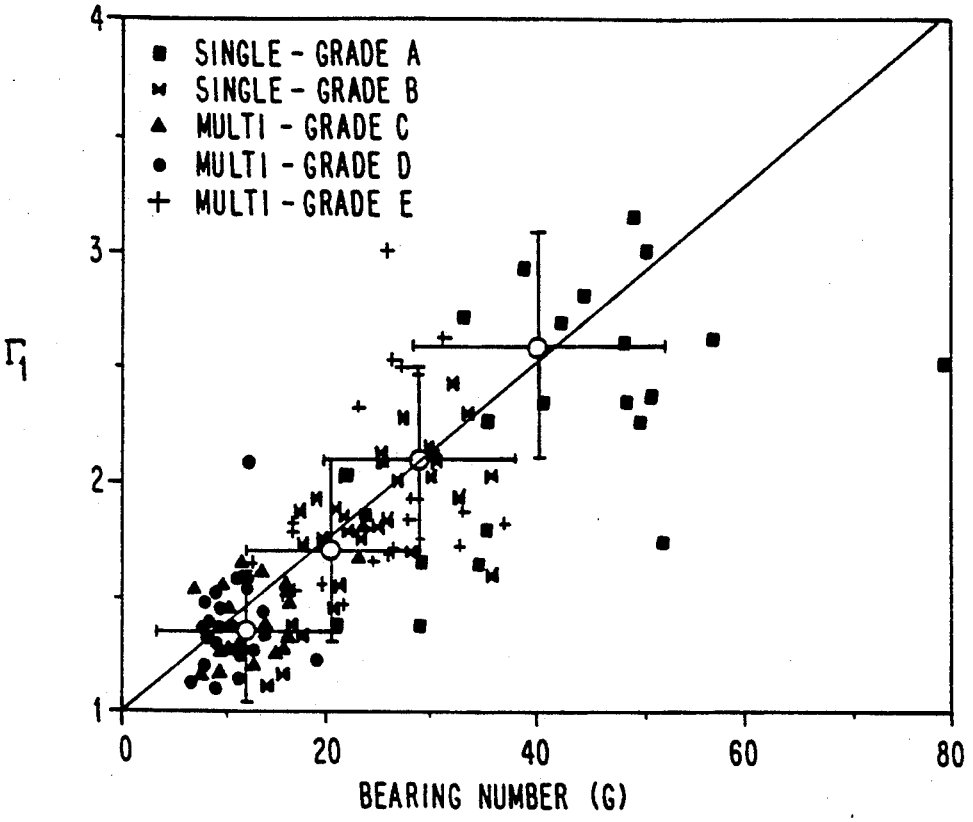
FIG. 9 is a data plot of the non-dimensional inlet wetting height against Bearing Number (G), for five different lubricant fluids, for a given piston ring.

A curve was fitted to the data of FIG. 6, as shown in FIG. 9, and representative points of $\Gamma_2$ were chosen in an iterative way so that calculated points of G and $\Gamma_1$ lie near the curve of FIG. 9 (indicated by the open circles). In this manner, one can obtain a good correlation between $\Gamma_1$ and $\Gamma_2$. The agreement between theory and observation implies that a high shear viscosity model is consistent with the experimental observations. For the exhaust data, $\Gamma_1/\Gamma_2=1.24$.

The broken-in compression ring in these tests had a relatively flat face, with a circular profile of radius a=90 mm. Because the ratio h/a is very small ($<10^{-4}$), a Taylor series expansion of the circular ring profile can be introduced around $h_o$. This results in the parabolic profile:

$$h(x)=h_o\frac{(x-x_0)^2}{2a} \tag{16}$$

where $h_o=h(x_o)$ defines the location $x_o$. The analytical solution to Eqns. (13) through (16) is thus similar to the one from Coyne & Elrod, supra.

Figure 10:
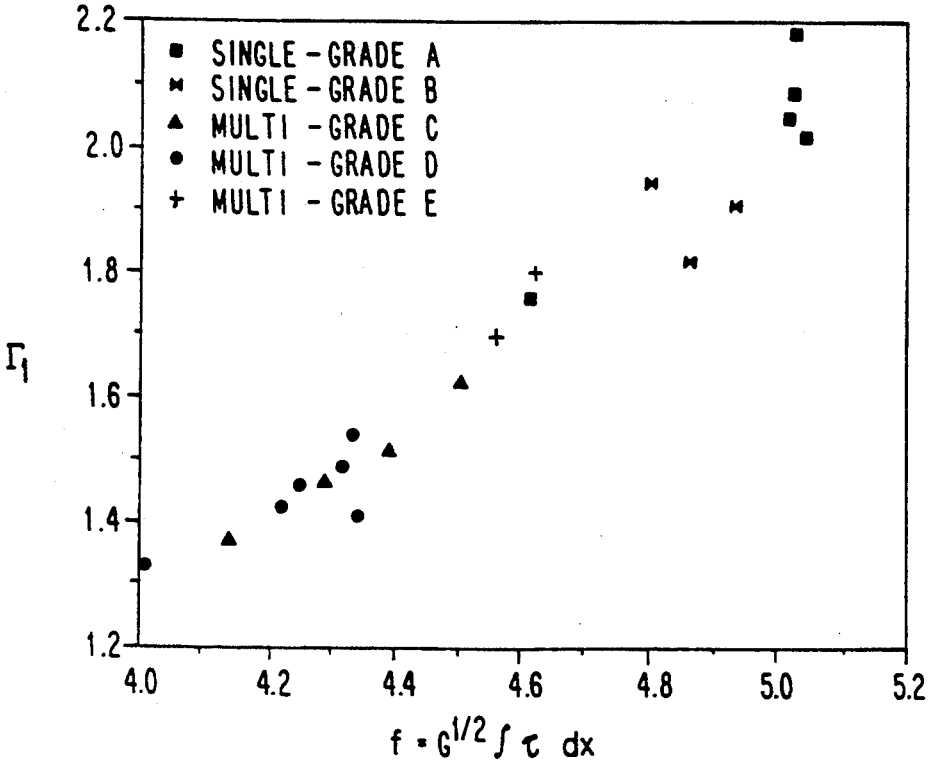
FIG. 10 is a data plot of non-dimensionalized inlet wetting height against computed friction value, for a given piston ring, for five different lubricant fluids.
Figure 11:
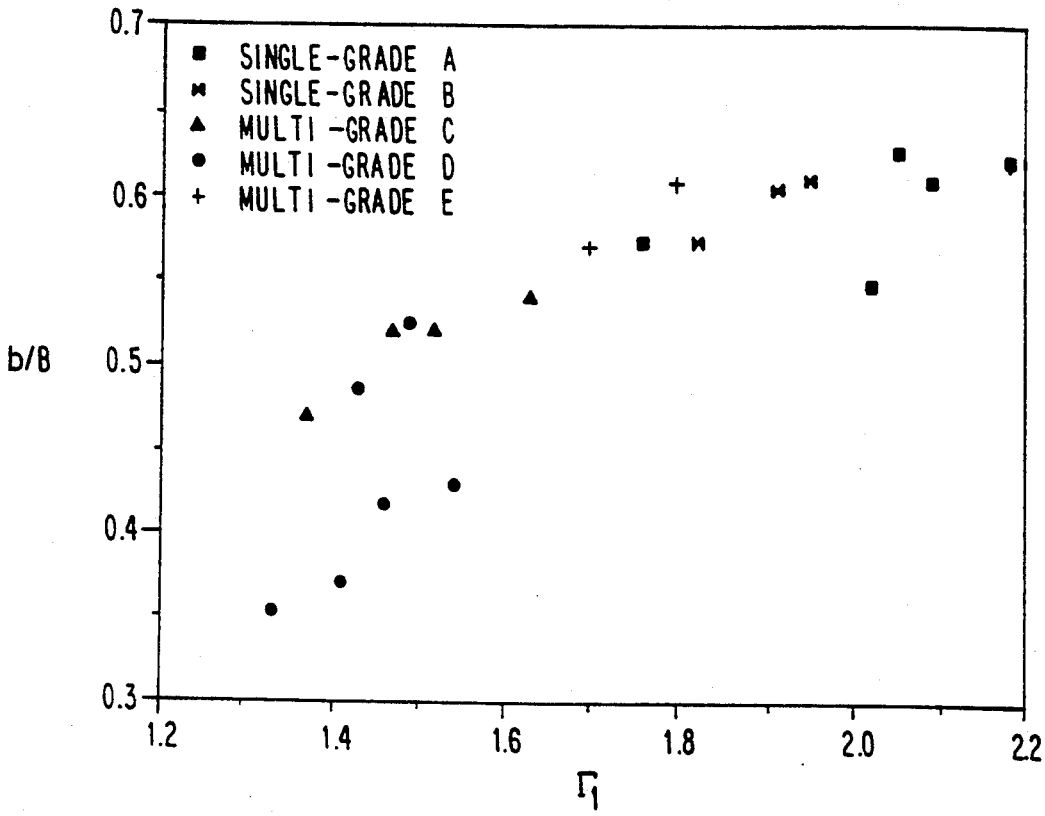
FIG. 11 is a data plot of non-dimensional wetting length against non-dimensional inlet wetting height, for a given piston ring, for five different lubricant fluids.
Figure 12:
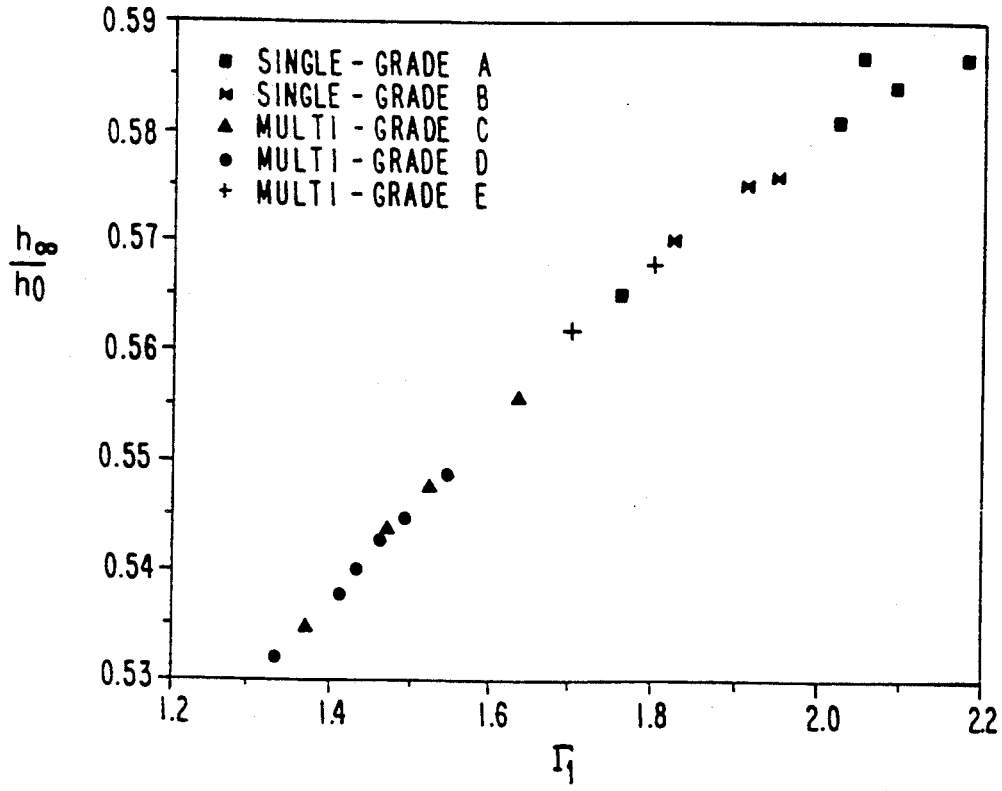
FIG. 12 is a data plot of non-dimensional upstream film thickness against non-dimensional inlet wetting height, for a given piston ring, for five different lubricant fluids.

The solutions to the preceding equations are plotted as $\Gamma_1$ versus f, b/B versus $\Gamma_1$, and $h_\infty/h_0$ versus $\Gamma_1$ for representative samples of the single and multigrade oils, as indicated in FIGS. 10–12. These plots show remarkably consistent trends.

First, f, b/B, and $h_\infty/h_0$ demonstrate a clear monotonically increasing trend with increasing $\Gamma_1$.

Second, there is a sharp separation between both multi- and single-grades, the single-grades showing: 1) higher friction, 2) a greater wetted inlet height and length, and 3) higher upstream film heights. There is a 20% maximum difference in friction between single and multigrade oils. See FIG. 10.

As was noted above with reference to FIG. 1, the ratio of the horizontal-to-vertical length scales, everywhere under the piston ring, is only on the order of 1:1000. The lubricant fluid flow under the piston ring, therefore, is very nearly parallel flow. Therefore, the basic assumptions of Reynold's lubrication theory, i.e., that the pressure through the lubricating film is constant and that the gradient of the pressure along the film is balanced by the normal gradient of shear stress are good approximations. Accordingly, it is believed that an adequate model of the fluid flow in question is one which describes lubricant shear in nearly parallel flow.

It has been argued in the literature that, based on the minimum oil film thickness (MOFT) measurements, the use of a shear-dependent viscosity yields an adequate rheological model. Estimates of the normal stress relaxation times for multigrade lubricants have been made. These times lead to relaxation length scales on the order of a few μm and such scales are much shorter than those required to explain the slow decay (within approximately 1 mm) of the free surface. For these reasons, a shear-dependent lubricant fluid viscosity is an acceptable assumption, as is the further assumption that in a given nearly parallel "Reynolds" flow the viscosity depends on the local strain rate. The strain rate everywhere between the top ring surface and the adjacent engine cylinder liner surface is between $10^4$ and $10^7$ $sec^{-1}$, hence use of a high strain rate viscosity is believed to be appropriate. Beyond the ring, in the free downstream regime, the strain rate decays to zero in about 1 mm, as mentioned earlier. See also FIG. 1.

In this invention, the basic hypothesis is that the missing boundary condition has the form of a surface tension gradient, and an appropriate non-dimensional coefficient for it is defined. Also, it is shown that this boundary condition produces an acceptable agreement with the observed experimental data for five lubricant fluids at four engine speeds.

Figure 14:
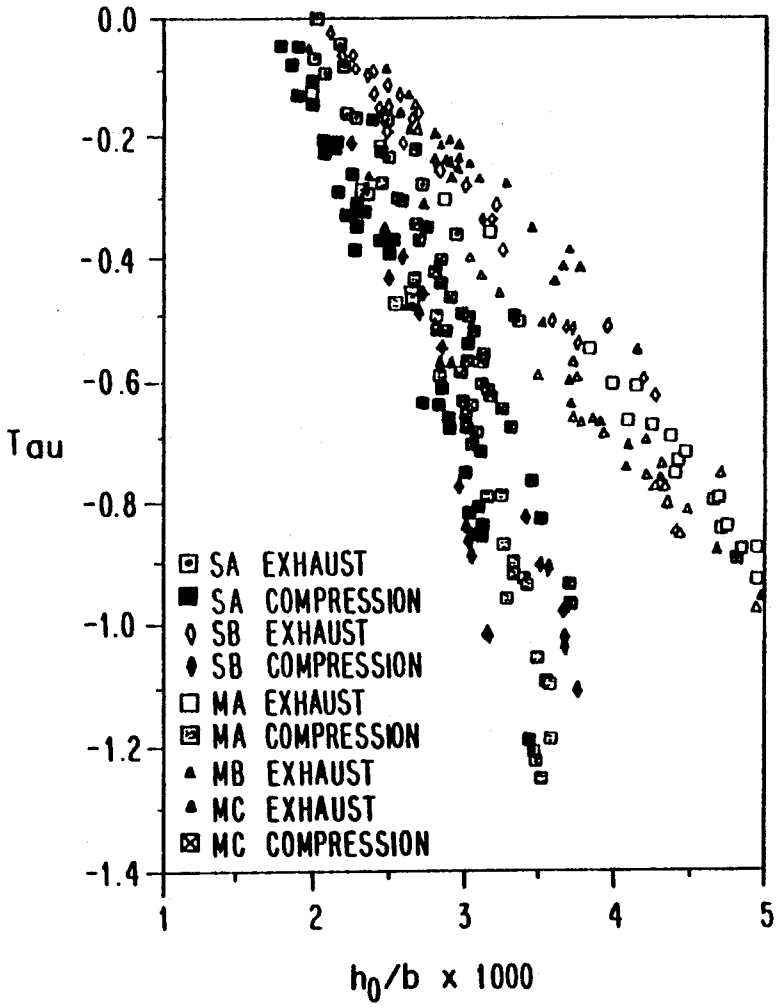
FIG. 14 is a data plot to determine the correlation of non-dimensional exit free surface shear stress with the parameter ($h_o/b$), for a number of lubricant fluids under comparable operating conditions.

Verification experiments were performed with the use of five commercially-available lubricant fluids, two of which are single-grade (labelled SA and SB) and three are multigrade (labelled MA, MB and MC), as set forth in FIG. 14 and other figures. The internal combustion engine used to perform the experiments was a single stroke IDI diesel engine with a 75 mm bore. The flow observations were conducted near the piston midstroke, both for compression and exhaust strokes. Direct experimental measurements led to the conclusion that the pressure loading across the top ring is appreciable during a compression stroke but is relatively negligible during a exhaust stroke.

Figure 13:
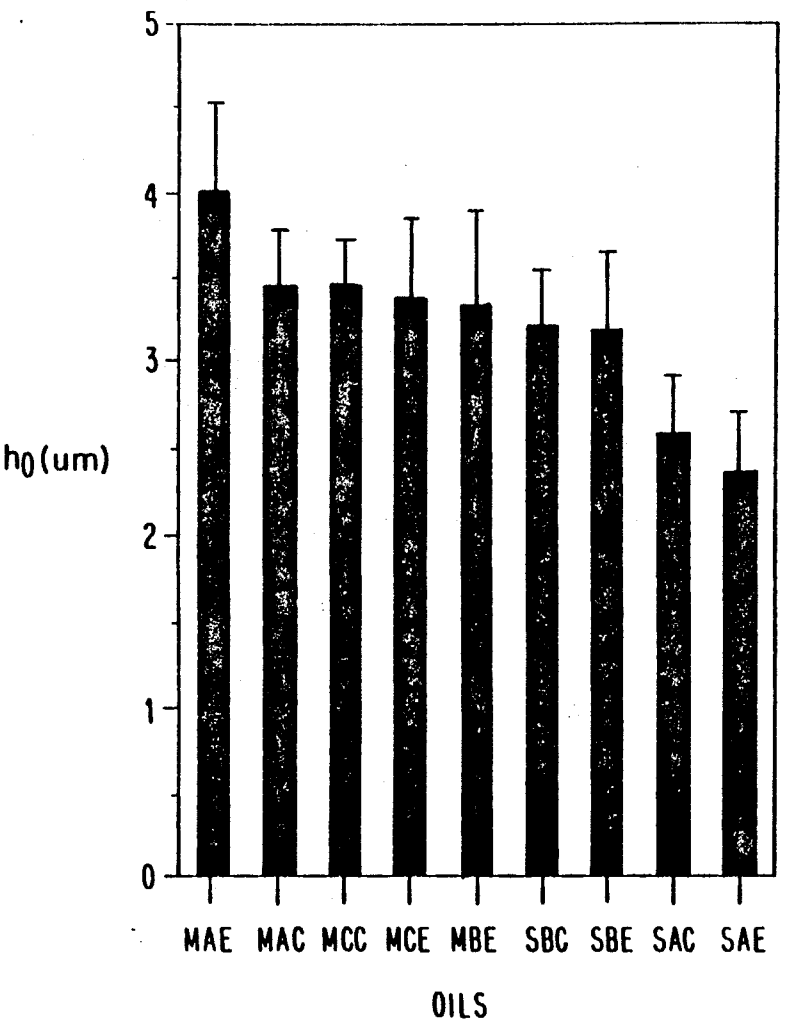
FIG. 13 is a bar plot of average minimum film thickness (in μm) for a number of different lubricant films under comparable conditions of use.

Even though all of the lubricant fluids used in the experiments were subjected to nearly the same operating conditions, the average minimum film thickness $\bar{h}_o$ between the top piston ring and the engine cylinder liner varied with the type of lubricant fluid used. Multigrade lubricants were found to have thicker oil film thicknesses than did single-grade lubricant fluids. See, for example, FIG. 13.

The top ring contour, after some time in use, wore into a circular arc of large radius. From Talysurf measurements, this radius was determined to be about 90 mm.

Figure 15:
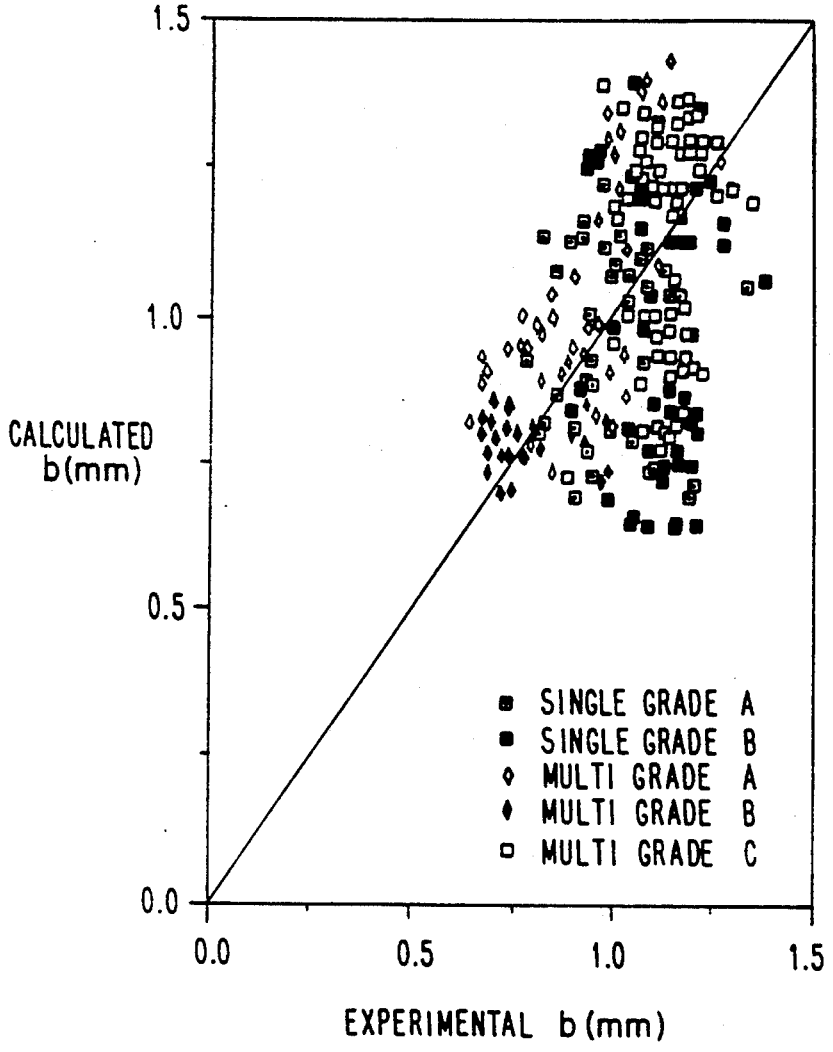
FIG. 15 is a data plot, with a linear curve fit, to enable comparison between a calculated lubricant film width at a piston ring with experimentally determined values thereof.
Figure 17:
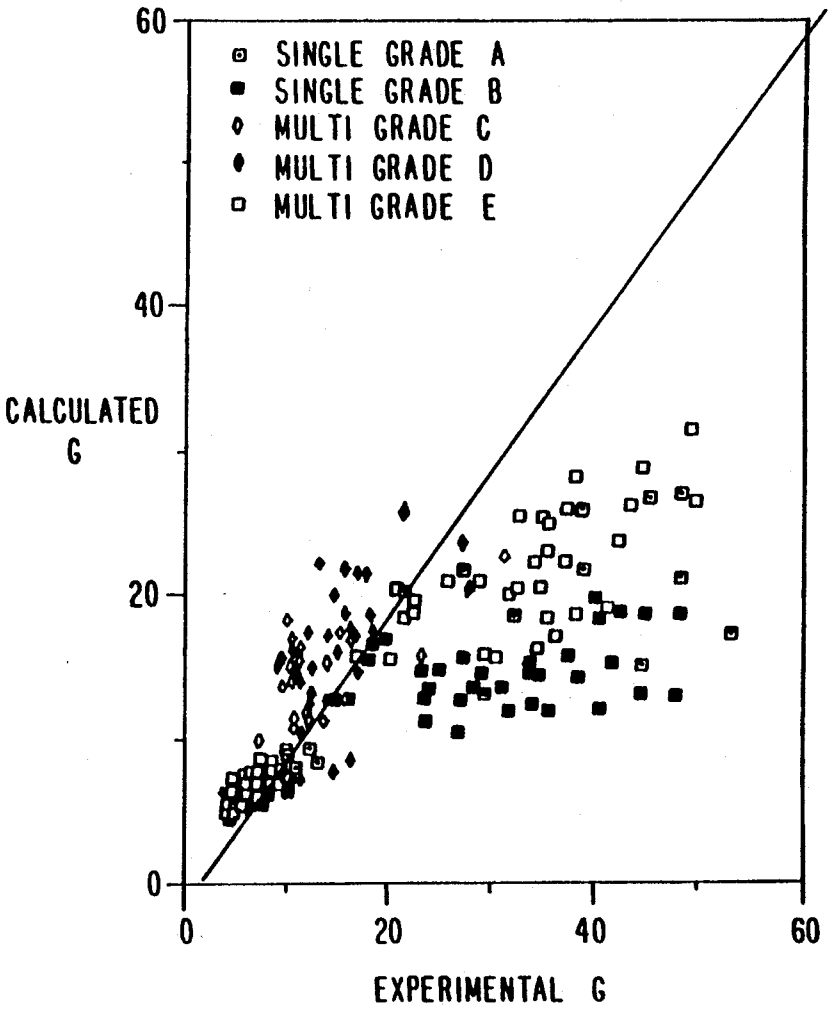
FIG. 17 is a data plot, with a linear curve fit, to enable comparison between calculated values of Bearing Number (G) against experimentally determined values therefor, for five different lubricant fluids.
Figure 16:
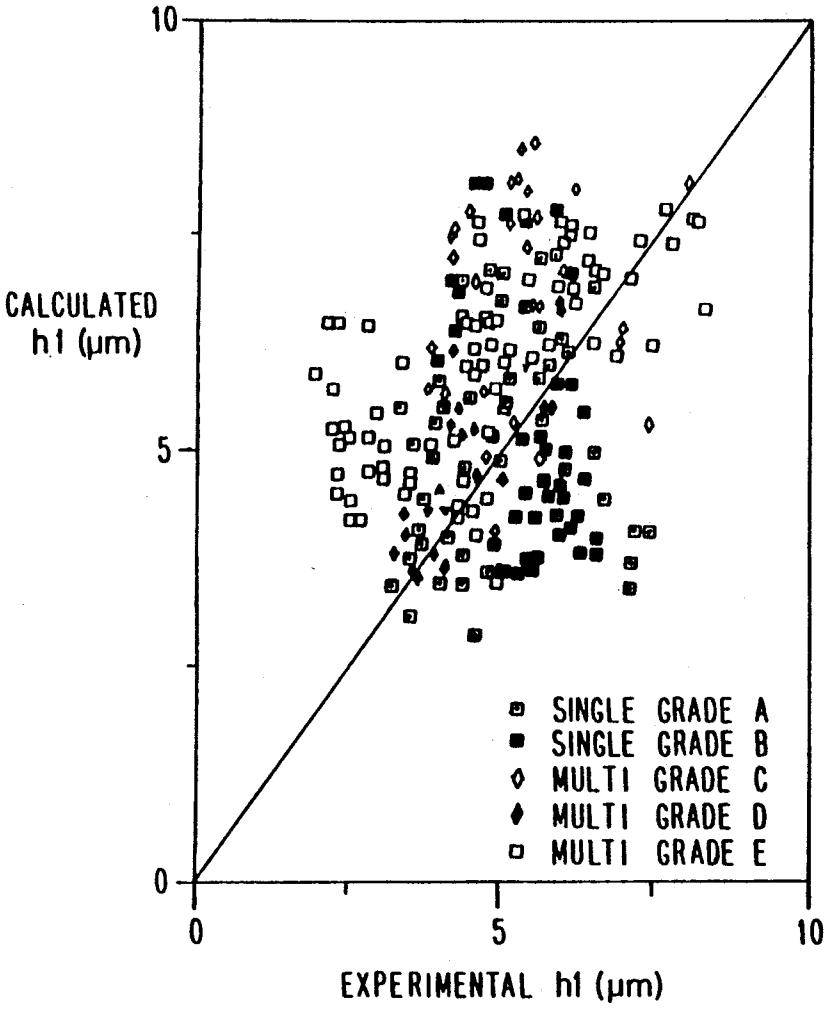
FIG. 16 is a data plot of calculated inlet height $h_1$ (in μm) plotted against experimentally determined values of $h_1$ (in μm) with a linear data fit to enable comparison therebetween.
Figure 19:
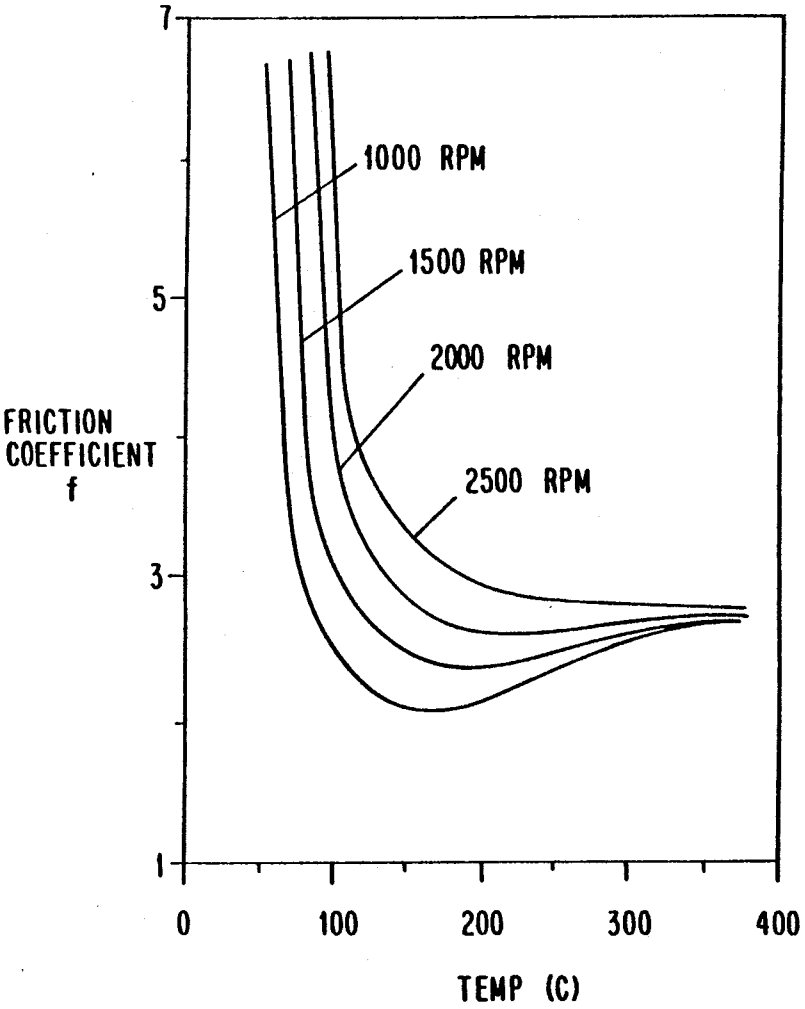
FIG. 19 graphically illustrates variations between friction coefficient "f" with respect to temperature (in °C.) for various engine operating speeds, during an exhaust stroke, for a single-grade lubricant fluid, for a minimum lubricant film thickness h=2.3 μm.
Figure 18:
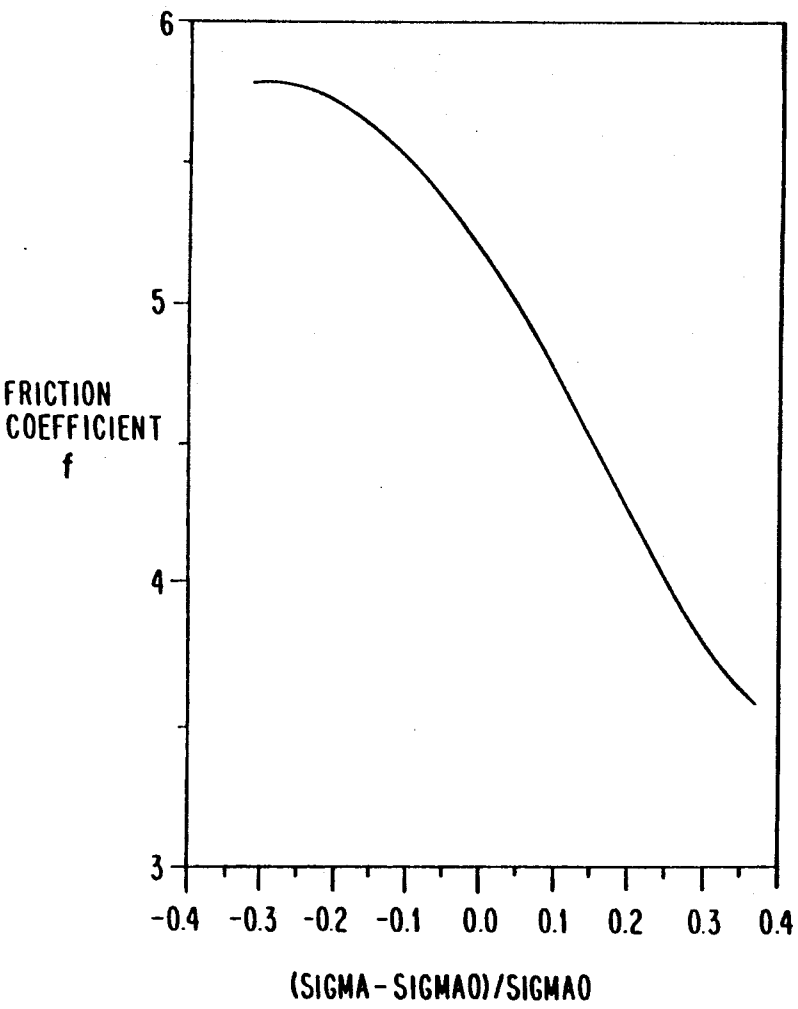
FIG. 18 is a plot of friction coefficient "f" against a parameter based on surface tension, to illustrate a relationship therebetween during an exhaust stroke for typical operating parameter values corresponding to the experimental data base.

FIG. 14 is a plot cf Tau ($\tau$) and ($h_o/b \times 1000$) for the five test fluids. FIG. 15 is a plot of calculated b and experimental b for the five test fluids. FIG. 16 is a plot of calculated $h_1$($\mu$m) and experimental h1 ($\mu$m) for the five test fluids. FIG. 17 is a plot of calculated G and experimental G for the five test fluids. FIG. 18 is a plot of friction coefficient and sigma-sigma O/sigma O, and FIG. 19 is a plot of friction coefficient and temperature at different RPMs.

The parameters necessary for a complete specification of the solution to the Reynolds equation are thus:

(i) velocity U (ii) load $\Delta$PB (iii) viscosity $\mu$, both high shear (under the ring) and low shear (on the free surface)

(iv) ring contour $$h(x)=h_o+(x+x_o)^2/2a \quad (17)$$

where a is the arc radius, where $x_o$ is the distance to the minimum point under the ring.

(v) the non-dimensionalized inlet and outlet pressures $\bar{P}_1$, $\bar{P}_2$.

(vi) either $h_o$ or $h_\infty$, the value of h far downstream.

(vii) an exit boundary condition as described previously.

It should be noted that both high shear viscosity and low shear surface tension are strong functions of temperature. Thus the Taylor Number of a given lubricant is also a strong function of temperature. Further, it should also be noted that the Taylor Numbers of the various lubricants, due to lubricant temperature changes, overlap. Thus there is no rigorous lubricant segregation according to friction. However, it is roughly true that multigrade lubricants have lower friction coefficients than single grade lubricants.

At constant temperature, $h_o$ (or $h_\infty$), viscosity, load and velocity, the friction coefficient increases with surface tension, as shown in FIG. 2. If all other variables are fixed at given levels, higher surface tension implies higher exit shear stress and therefore lower friction.

The differences between the frictional properties of single-grade and multigrade lubricants can be explained with this effect. If everything else is held fixed, higher surface tension leads to reduced friction. However, in practice, lower friction may lead to higher cylinder liner temperatures, which could cause friction to act in the opposite direction.

By using the principles of the present invention, a lubricant for a particular internal combustion engine can be customized which will operate most efficiently at the normal operating temperature of the engine. This is done by determining the optimum viscosity and surface tension of an engine at the normal operating temperature and then adjusting the surface tension, viscosity, and ratio of surface tension to viscosity of the lubricant as necessary as described herein.

The following Table 1 sets forth the surface and frictional characteristics for the test oils. In this table surface tension is reported in dyne/cm. This surface tension unit can be multiplied by $10^{-3}$ to obtain N/m.

The test lubricant fluids (oils) of Table 1 were used to develop the inventive model set forth herein. The surface tension data in Table 1 was bench data used to evaluate the friction models. In Table 1, TBS viscosity is high temperature, high shear viscosity. EHD film thickness is on elastic hydrodynamic bench test for film thickness.

The following Table 2 reports surface tension at the same varied temperatures and fuel economy data for a series of reference oils, both single-grade and multigrade oils. These oils are indicated as A–K and by SAE number.

Table 3 sets forth the frictional characteristics of the test oils of Table 2.

Table 4 sets forth the densities of both the test oils of Table 1 and the reference oils of Table 2.

The reference oils of Tables 2, 3 and 4 were used as reference oils to prove the model as to the effect of surface tension on fuel economy.

TABLE 1

Surface and Frictional Characteristics of Test Oils

| Test Oils | MA | SA | MB | MC | SB |
|---|---|---|---|---|---|
| Surface Tension, dyne/cm | | | | | |
| 50° C. | 28.7 | 28.0 | 27.1 | 26.6 | 27.1 |
| 100° C. | 25.0 | 24.3 | 22.9 | 22.2 | 22.2 |
| 133° C. | 22.3 | 21.7 | 20.1 | 19.4 | 19.2 |
| 167° C. | 20.5 | 19.7 | 18.4 | 17.3 | 16.5 |
| 200° C. | 17.8 | 17.3 | 17.0 | 16.1 | 15.0 |
| TBS Viscosity, cP @ 150° C. and 10° sec$^{-1}$ | 3.83 | 3.41 | 4.60 | 3.76 | 3.08 |
| TBS Viscosity, cP @ 150° C. and 10° sec$^{-1}$ after FISST | 3.49 | 3.42 | 4.52 | 3.84 | 3.11 |
| Kin Vis @ 40° C., cSt | 66.11 | 59.58 | 83.78 | 67.41 | 69.39 |
| Kin Vis @ 100° C., cSt | 11.38 | 8.89 | 15.59 | 11.56 | 9.39 |
| VI | 167 | 125 | 199 | 167 | 113 |
| EHD Film Thickness Ambient, 25° C. microns | 0.420 | 0.650 | 0.390 | 0.420 | 0.600 |

TABLE 1-continued

| Surface and Frictional Characteristics of Test Oils | | | | | |
|---|---|---|---|---|---|
| Test Oils | MA | SA | MB | MC | SB |
| EHD Film Thickness 100° C. Extrapolated microns | 0.064 | 0.073 | 0.061 | 0.060 | 0.061 |

TABLE 2

| Surface Tension and Fuel Economy Data for the Reference Oils | | | | | | | | |
|---|---|---|---|---|---|---|---|---|
| | | Surface Tension (dyne/cm) | | | | | Fuel Economy | |
| Reference Oils | | 50° C. | 100° C. | 133° C. | 167° C. | 200° C. | ASTM Five Car, % FE | ASTM Seq VI, FE |
| A | SAE 50 | 30.0 | 25.9 | 22.8 | 20.6 | 18.8 | | |
| B | SAE 20W30 | 28.8 | 25.4 | 22.5 | 20.5 | 18.7 | 0 | 0 |
| C | SAE 20W30 | 29.2 | 25.1 | 22.5 | 20.5 | 18.9 | 0.96 | — |
| D | SAE 10W30 | 28.2 | 24.8 | 22.4 | 20.3 | 18.7 | 3.23(2)* | 3.32(1) |
| E | SAE 10W30 | 28.2 | 24.1 | 21.6 | 19.9 | 18.5 | 1.13(5) | 0.75(19) |
| F | SAE 10W30 | 28.2 | 24.4 | 21.5 | 19.8 | 18.2 | 2.70(2) | 2.82(11) |
| G | SAE 10W30 | 28.1 | 24.4 | 21.3 | 19.4 | 18.0 | 1.95(3) | 2.20(11) |
| H | SAE 10W40 | 27.7 | 23.2 | 20.7 | 19.4 | 18.2 | 2.22(3) | 2.20(16) |
| I | SAE 5W30 | 27.5 | 23.1 | 20.4 | 19.0 | 17.6 | 2.73(3) | 2.11(20) |
| J | SAE 5W30 | 26.5 | 21.9 | 19.8 | 18.9 | 16.7 | 2.77(2) | 2.79(2) |
| K | SAE 5W20 | 25.7 | 21.2 | 19.2 | 17.6 | 16.5 | 3.25(1) | 3.17(16) |

*Number of engine tests is given between parenthesis.

TABLE 3

| Frictional Characteristics of the Reference Oils | | | | | | | | | | |
|---|---|---|---|---|---|---|---|---|---|---|
| | | PROCID Friction | EHD Film Thickness (microns) | | | | TBS Vis (cP) | Kin ViS (cSt) | | |
| | | | Amb. | Extrapolated | | | | | | |
| Reference Oils | | 100° C. | (23° C.*) | 75° C. | 100° C. | 100° C. | 150° C. | 40° C. | 100° C. | VI |
| A | SAE 30 | 0.147 | 1.25 (25° C.) | 0.30 | 0.14 | 12.6 | 5.4 | 226 | 19.6 | 99 |
| B | SAE 20W30 | 0.157 | 0.52 | 0.19 | 0.11 | 8.0 | 3.1 | 74.2 | 9.5 | 106 |
| C | SAE 20W30 | 0.044 | 0.52 | 0.19 | 0.11 | 8.0 | 2.9 | 74.1 | 9.5 | 106 |
| D | SAE 10W30 | 0.143 | 0.17 | 0.08 | 0.022 | 7.1 | 3.2 | 68.5 | 10.6 | 142 |
| E | SAE 10W30 | 0.142 | 0.33 | 0.12 | 0.070 | 8.1 | 3.5 | 77.0 | 11.3 | 139 |
| F | SAE 10W30 | 0.115 | 0.29 (25° C.) | 0.11 | 0.060 | 6.8 | 2.8 | 62.0 | 10.6 | 163 |
| G | SAE 10W30 | 0.140 | 0.36 | 0.11 | 0.064 | 7.4 | 3.0 | 73.1 | 10.6 | 133 |
| H | SAE 10W40 | 0.146 | 0.26 | 0.10 | 0.058 | 7.1 | 3.1 | 91.2 | 14.0 | 157 |
| I | SAE 5W30 | 0.140 | 0.25 | 0.10 | 0.061 | 5.3 | 2.6 | 57.4 | 9.8 | 157 |
| J | SAE 5W30 | 0.145 | 0.27 | 0.07 | 0.037 | 6.7 | 2.9 | 61.4 | 10.3 | 157 |
| K | SAE 5W20 | 0.146 | 0.20 | 0.08 | 0.05 | 5.3 | 2.1 | 34.1 | 6.4 | 143 |

*Test temperatures are given between parenthesis when different.

TABLE 4

| | Density g/ml |
|---|---|
| Test Oils (Lubricant Fluids) | |
| MC | 0.8928 |
| SA | 0.8981 |
| MB | 0.8776 |
| SB | 0.8942 |
| MA | 0.8933 |
| Reference Oils (Lubricant Fluids) | |
| A | 0.898 |
| B | 0.887 |
| C | 0.888 |
| D | 0.86 |
| E | 0.878 |
| F | 0.887 |
| G | 0.874 |
| H | 0.888 |
| I | 0.870 |
| J | 0.871 |
| K | 0.870 |

The present invention provides data to show that surface tension, and the combination of surface tension and viscosity values, are key characteristics in providing a lubricating oil which provides optimum efficiency for operating an internal combustion engine under normal operating conditions. The lubricating oil of the invention exhibits improved friction values and thus improves efficiencies.

Using the principles described herein, improved lubricant fluids are provided which have optimum viscosity and surface tension values which increase their lubricant efficiency. The lubricant fluid basically comprises a base oil or lubricating oil which has optimum viscosity and surface tension characteristics and ratios. As necessary, the base oil may contain a viscosity modifying component, and/or a surface tension modifying component. The viscosity modifying component, if necessary, should provide a lubricant fluid viscosity in the range of $2\times10^{-3}$ to $5\times10^{-3}$ Pa-sec. Generally, the viscosity will be by a viscosity improver to provide the desired viscosity. About 3-15 wt. % of a viscosity index improver is generally satisfactory based on the amount of base oil.

As noted, the base oil may be modified by addition of about 3 to 15 wt. % of a viscosity index improver so as to obtain a fluid viscosity in the range of $3\times10^{-3}$ to $5\times10^{-3}$ Pa-sec. Viscosity index (V.I.) improvers are well known in the art and can include known V.I. improvers produced from polybutylenes, polymethacrylates, and polyalkylstyrenes. The viscosity index (VI) for any given oil can be derived by measuring the viscosity of the oil at 40° C. and 100° C., and then calculating the viscosity index from detailed tables published by the ASTM (ASTM Standard D 2270). Preferred improvers are dispersants and/or detergents.

The surface tension of the base oil can be modified to provide a lubricant fluid surface tension of at least about $2\times10^{-2}$ N/m, and preferably in the range of $2\times10^{-2}$ N/m to $5\times10^{-2}$ N/m. The surface tension can be modified by adding a detergent or dispersant in an amount of about 3–15% by weight based on the amount of base lubricant oil.

These additives therefore can be used to improve the base oil to provide a multi-viscosity, multi-component lubricant fluid which has improved viscosity and improved surface tension which will reduce friction when used in an internal combustion engine.

For any lubricating oil according to the invention, it is also necessary that the base oil exhibit a critical ratio of surface tension to viscosity. It should be noted that any one lubricant or base oil will not have the same surface tension to viscosity ratio over all temperature ranges. However, the preferred lubricating oil will have a ratio of surface tension (N/m) to viscosity (Pa-sec) in the range from 4 to 16.7 in m/sec.

It is also a feature of the invention to provide other additives to the base oil such as 0–0.7% by weight of a pour point depressant. Conventional pour point depressants such as polymethylcrylates and the like may be used. Other additives may be included. For example, up to 0.1 wt. % may be added of commercial additive packages formulated to contain the necessary detergents, dispersants, corrosion/rust inhibitors, antioxidants, antiwear additives, defoamers, metal passivators, set point reducers, and the like to meet a specific API Service Rating when employed at the recommended usage level. A suitable pour point depressant is sold by Rohn Tech as Viscoplex 1-330.

In a preferred embodiment, the present invention provides a lubricating oil formulation containing the following essential components:

| Component | Amount wt. % |
|---|---|
| a) Base oil | 70–92 |
| b) Viscosity index improver | 3–15 |
| c) Surface tension modifier | 3–15 |

and wherein the ratio of surface tension (N/m) to viscosity (Pa-sec), ranges from 4 to 16.7 in m/sec.

The base oil for the lubricants of the invention may be any conventional lubricating oil conventionally used in internal combustion engines. A preferred lubricating or base oil according to the invention is sold under the Atlas trade name by Pennzoil Products Company.

A dispersant inhibitor (DI) package is preferably used to improve the surface tension of the base oil. Suitable DI are sold under the tradename Amoco 6948 and Amoco 6919C by Amoco. In use of these additives, it has been found that the Amoco 6948 DI package provides better results than Amoco 6919C on low shear surface tension.

Dispersant inhibitor packages conventionally contain anti-wear components, dispersants, detergents and antioxidants. Amoco 6948, for example is a DI package which contains anti-wear zinc dialkyldithiophosphate wherein the side chains include isopropyl, isobutyl, 4-methyl-2-pentyl, 2-methyl-butyl, and n-pentyl, polyisobutylene succimide dispersant, a calcium/magnesium sulfonate phenate as a detergent, and an ashless antioxidant comprising octyl-substituted diphenylamine.

Amoco 6919C, a second suitable DI package, contains zinc dialkyldithiophosphate with isopropyl-, n-alkyl-, and 4-methyl-2-pentyl side chains. The package also contains Mannich base as a dispersant, a calcium/magnesium sulfonate phenate as a detergent, and octyl-substituted diphenylamine as an ashless antioxidant.

Accordingly, the present invention provides improved lubricant compositions which provide lubrication to internal combustion engines with less friction than those known heretofore. The present invention therefore provides a method for increasing the operational efficiency of an internal combustion engine by adjusting the viscosity and surface tension of a base oil to optimum values.

The following examples are presented to illustrate the invention but it is to be considered as limited thereto. In the examples, parts are by weight unless otherwise indicated.

EXAMPLE 1

The following formulations of the invention were prepared containing the indicated amounts of additives. In the following formulations, Atlas P-100 HVI, Atlas P-100 SE, Atlas P-325 HT and Atlas P-600 SE are base oils available from Pennzoil Products Company. Amoco 6948 and Amoco 6919C are dispersant inhibitor packages as described above, available from Amoco oil Company. Shellvis 200 and Texaco TLA 7200A are viscosity index improvers available from Shell Oil Company and Texaco Oil, respectively. Rohm Tech Viscoplex 1-330 is a pour point depressant available from Rohm Tech.

| Component | Wt. % |
|---|---|
| (A) Atlas P-100 HVI | 78.48 |
| Amoco 6948 | 12.11 |
| Texaco TLA 7200A | 8.88 |
| Rohm-Tech Viscoplex 1-330 | 0.53 |
| (B) Atlas P-100 HVI | 54.94 |
| Atlas P-100 SE | 23.54 |
| Amoco 6948 | 12.11 |
| Texaco TLA 7200A | 8.88 |
| Rohm-Tech Viscoplex 1-330 | 0.53 |
| (C) Atlas P-100 HVI | 23.54 |
| Atlas P-100 SE | 54.94 |
| Amoco 6919C | 12.11 |
| Texaco TLA 7200A | 8.88 |
| Rohm-Tech Viscoplex 1-330 | 0.53 |
| (D) Atlas P-100 HVI | 23.54 |
| Atlas P-100 SE | 54.94 |
| Amoco 6948 | 12.11 |
| Shellvis 200 | 8.88 |
| Rohm-Tech Viscoplex 1-330 | 0.53 |
| (E) Atlas P-100 HVI | 54.94 |
| Atlas P-100 SE | 23.54 |
| Amoco 6919C | 12.11 |
| Shellvis 200 | 8.88 |
| Rohm-Tech Viscoplex 1-330 | 0.53 |
| (F) Atlas P-100 HVI | 23.54 |
| Atlas P-100 SE | 54.94 |
| Amoco 6919C | 12.11 |
| Shellvis 200 | 8.88 |
| Rohm-Tech Viscoplex 1-330 | 0.53 |
| (G) Atlas P-100 HVI | 54.94 |
| Atlas P-100 SE | 23.54 |
| Amoco 6919C | 12.11 |
| Texaco TLA 7200A | 8.88 |
| Rohm-Tech Viscoplex 1-330 | 0.53 |
| (H) Atlas P-100 HVI | 23.54 |
| Atlas P-100 SE | 54.94 |
| Amoco 6948 | 12.11 |
| Texaco TLA 7200A | 8.88 |
| Rohm-Tech Viscoplex 1-330 | 0.53 |
| (I) Atlas P-100 HVI | 54.94 |
| Atlas P-100 SE | 23.54 |
| Amoco 6948 | 12.11 |
| Shellvis 200 | 8.88 |

-continued

| Component | Wt. % |
|---|---|
| Rohm-Tech Viscoplex 1-330 | 0.53 |
| (J) Atlas P-100 HVI | 81.21 |
| Amoco 6919C | 10.90 |
| Shellvis 200 | 7.36 |
| Rohm-Tech Viscoplex 1-330 | 0.53 |
| (K) Atlas P-100 SE | 55.06 |
| Atlas P-325 HT | 30.53 |
| Amoco 6919C | 9.63 |
| Shellvis 200 | 4.47 |
| Rohm-Tech Viscoplex 1-330 | 0.31 |
| (L) Atlas P-100 SE | 58.61 |
| Atlas P-325 HT | 21.90 |
| Amoco 6919C | 10.74 |
| Shellvis 200 | 8.44 |
| Rohm-Tech Viscoplex 1-330 | 0.31 |
| (M) Atlas P-100 HVI | 84.23 |
| Amoco 6919C | 10.90 |
| Shellvis 200 | 4.34 |
| Rohm-Tech Viscoplex 1-330 | 0.53 |
| (N) Atlas P-325 HT | 51.52 |
| Atlas P-600 SE | 34.02 |
| Amoco 6919C | 9.51 |
| Shellvis 200 | 4.80 |
| Rohm-Tech Viscoplex 1-330 | 0.15 |
| (O) Atlas P-100 SE | 44.03 |
| Atlas P-325 HT | 37.04 |
| Amoco 6919C | 10.70 |
| Shellvis 200 | 7.92 |
| Rohm-Tech Viscoplex 1-330 | 0.31 |

The invention has been described herein with reference to certain preferred embodiments. However, as obvious variations thereon will become apparent to those skilled in the art, the invention is not to be considered as limited thereto.

What is claimed is:

1. A method for ensuring efficient lubrication by a lubricant fluid comprising a lubricating oil, when used in an internal combustion engine to reduce frictional losses and improve fuel economy, comprising the steps of:

operating the engine until a selected operating condition thereof is attained;

observing an engine operating temperature corresponding to said operating condition;

determining whether the viscosity of the lubricant fluid is within a viscosity range of $2\times10^{-3}$ to $5\times10^{-3}$ Pa-sec, and whether the surface tension of the lubricant fluid is in the range of $1\times10^{-2}$ to $5\times10^{-2}$ Newtons/m at a lubricant shear rate of $10^6$ $sec^{-1}$ at said observed engine operating temperature;

adding a known viscosity modifying additive to the lubricant fluid to adjust the viscosity to be within said viscosity range and adding a known surface tension modifying additive to the lubricant fluid to adjust the surface tension thereof to at least $5\times10^{-2}$ Newtons/m.

2. A method for improving the properties of a lubricant fluid used to provide lubrication, comprising the steps of:

providing a lubricant fluid having a viscosity in a viscosity range of $2\times10^{-3}$ to $5\times10^{-2}$ Pa-sec and a surface tension in a surface tension range of $1\times10^{-2}$ Newtons/m to $5\times10^{-2}$ Newtons/m, measured at a shear rate of $10^6$ $sec^{-1}$, in a temperature range of 100° to 120° C.;

determining the viscosity of the lubricant fluid during said use to provide lubrication; and adding known modifying and surface tension modifying additives to the lubricant fluid to ensure that the viscosity and surface tension of the lubricant fluid with said additives mixed in, during said use, are in the respective indicated viscosity and surface tension ranges.

3. A method according to claim 2, wherein;

the surface tension is maintained at approximately $5\times10^{-2}$ Newtons/m during said use.

4. A method for minimizing fluid frictional losses in operating an internal combustion engine lubricated by a lubricant fluid, comprising the steps of:

determining an operational temperature of the lubricant fluid during a selected engine operation;

determining a corresponding value of viscosity, in Pa-sec;

determining a corresponding value of surface tension for the lubricant fluid, in Newtons/m';

adding a known viscosity modifier to the lubricant fluid to modify the lubricant fluid to ensure that the lubricant fluid viscosity is in a viscosity range of $2\times10^{-3}$ to $5\times10^{-3}$ Pa-Sec; and adding a known surface tension modifier to the lubricant fluid in a quantity sufficient to ensure that the surface tension of the modified lubricant fluid has a value not less than $1\times10^{-3}$ Newtons/m at a shear rate of $10^6$ $sec^{-1}$.

5. The method according to claim 4, wherein: the surface tension of the modified lubricant fluid is increased to $5\times10^{-3}$ Newtons/m by the addition of a sufficient amount of the surface tension modifier thereto.

6. A method for increasing an operational efficiency of a selected type of internal combustion engine lubricated by a lubricant fluid, which engine includes a piston reciprocating inside a cylinder liner and has on the piston a sealing ring having a curved outer peripheral surface disposed to press outwardly against an adjacent liner surface, by controlling fluid frictional losses in the engine that are attributable to a lubricant fluid film formed between a curved outer surface of the sealing ring and the adjacent cylinder liner surface, comprising the steps of:

(a) determining a thickness profile of the lubricant fluid film between the outer peripheral surface of the sealing ring and the adjacent liner surface when the piston is at a mid-stroke position;

(b) determining from the thickness profile values of a minimum lubricant fluid film thickness h, a wetted length b of the piston ring corresponding to the lubricant fluid film and an overall thickness B of the piston ring;

(c) determining a bearing number G according to $$G=\mu_\infty Ub^2/\Delta PBh_o^2$$

where G is said bearing number, $\mu_\infty$ is the dynamic viscosity of the lubricant fluid (Pa-sec), U is a cylinder liner viscosity (m/s), b is the wetted ring width, $\Delta P$ is a ring elastic pressure (Pa), B is a ring width (mm) and $h_o$ is a minimum lubricant fluid film thickness under the ring ($\mu$m);

(d) determining values of average lubricant fluid film pressure $P_1$ at a first crown land and pressure $P_2$ at a second crown land;

(e) determining a frictional coefficient for the lubricant fluid at said sealing ring under a selected engine operating condition, in accordance with the equation;

$$f = G^{\frac{1}{2}} \int_{o}^{1} \tilde{\tau}\, d\tilde{x} = f(\Gamma_1, \Gamma_2, \tilde{P}_1, \tilde{P}_2),$$

where the distribution of $\Gamma$, as it varies with the dimension of the piston ring, is determined by solving the Reynolds equation, subject to the requirement that the ring carries the load applied, the upstream pressure is $P_1$. the downstream pressure is $P_2$, and the non-dimensional shear stress on the free surface where the lubricant exits from the ring is $$\tilde{\tau} = \frac{1}{Ta}\left(\frac{h_0}{b}\right)\sigma^*, \text{ and}$$

-continued $$T_a = \mu_\infty\, U/\sigma_o$$

wherein $\mu_\infty$ is the viscosity of the lubricant fluid at a high strain rate between the piston ring and the liner, $\sigma_o$ is the low strain rate surface tension, and $\sigma^*$ is in the range of $500 \pm 75$ for all lubricant fluids;

minimizing said frictional coefficient to reduce the lubricant fluid-related frictional losses while providing lubrication to said engine under operating conditions, by adding a known viscosity modifier to the lubricant fluid to maintain the lubricant fluid viscosity in the range of $2 \times 10^{-3}$ to $5 \times 10^{-3}$ Pa-sec, and adding a known surface tension modifier to the lubricant fluid to maintain the surface tension at a value not less than $1 \times 10^{-2}$ N/m, and not higher than $5 \times 10^{-2}$ N/m.

7. A method according to claim 6, wherein: said thickness profile of the lubricant films is determined by a known laser induced fluoroscopy (LIF) technique.

* * * * *

UNITED STATES PATENT AND TRADEMARK OFFICE

CERTIFICATE OF CORRECTION

PATENT NO. : 5,320,761

DATED : June 14, 1994

INVENTOR(S) : David P. Hoult, et al

It is certified that error appears in the above-indentified patent and that said Letters Patent is hereby corrected as shown below:

On the Title Page, item [73], add the following information:

--Massachusetts Institute of Technology,
Cambridge, MA--

Signed and Sealed this

Twenty-eight Day of February, 1995

*Attest:*

*Attesting Officer*

BRUCE LEHMAN

*Commissioner of Patents and Trademarks*